US006436199B1

(12) United States Patent
Hayakawa et al.

(10) Patent No.: US 6,436,199 B1
(45) Date of Patent: Aug. 20, 2002

(54) NON-ORIENTED MAGNETIC STEEL SHEET HAVING LOW IRON LOSS AND HIGH MAGNETIC FLUX DENSITY AND MANUFACTURING METHOD THEREFOR

(75) Inventors: Yasuyuki Hayakawa; Mitsumasa Kurosawa; Masaki Kawano; Michiro Komatsubara; Yuka Komori; Kazuaki Tamura, all of Okayama (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/649,052

(22) Filed: Aug. 29, 2000

(30) Foreign Application Priority Data

Sep. 3, 1999 (JP) ..... 11-249718
Mar. 3, 2000 (JP) ..... 2000-058130

(51) Int. Cl.[7] ..... H01F 1/04
(52) U.S. Cl. ..... 148/111
(58) Field of Search ..... 148/111, 112

(56) References Cited

U.S. PATENT DOCUMENTS 4,265,682 A * 5/1981 Tsuya et al. ..... 148/112
4,666,534 A * 5/1987 Miyoshi et al. ..... 148/111
5,108,522 A * 4/1992 Nishimoto et al. ..... 148/111
5,421,912 A * 6/1995 Kumano et al. ..... 148/111

FOREIGN PATENT DOCUMENTS

JP 63-137122 * 6/1988 ..... 148/111
JP 3-100122 * 4/1991 ..... 148/111
JP 5-186834 * 7/1993 ..... 148/112
JP 6-240358 * 6/1994 ..... 148/111

* cited by examiner

*Primary Examiner*—John P Sheehan
(74) *Attorney, Agent, or Firm*—Young & Thompson

(57) ABSTRACT

Non-oriented magnetic steel sheets, which are mainly used as materials for iron cores for use in electric apparatuses, have a low iron loss and a high magnetic flux density at the same time. The non-oriented magnetic steel sheet comprises from about 1.5 to about 8.0 weight % Si, from about 0.005 to about 2.50 weight % Mn, and not more than about 50 ppm each of C, S, N, O, and B, in which a crystal orientation parameter <Γ> is 0.200 or less. In addition, the average crystal grain diameter is preferably from about 50 to about 500 μm, and an areal ratio of crystal grains on a surface of the steel sheet is preferably 20% and less, in which crystal plane orientations of the crystal grains are within 15° from the <111> axis. In addition, the non-oriented magnetic steel sheet preferably contains small amounts of elements such as Al, Sb, Ni, Sn, Cu, P, and Cr. The manufacturing method for the non-oriented magnetic steel is also described.

7 Claims, 12 Drawing Sheets

NON-ORIENTED MAGNETIC STEEL SHEET HAVING LOW IRON LOSS AND HIGH MAGNETIC FLUX DENSITY AND MANUFACTURING METHOD THEREFOR

BACKGROUND OF THE INVENTION

1. Field of the Invention

The present invention relates to a non-oriented magnetic steel sheet primarily used for iron cores for electric apparatuses and to a manufacturing method therefor.

2. Description of the Related Art

Recently, in the worldwide trend toward energy saving, typically electric power energy saving, compact electric apparatuses having increased efficiency have been desired. In this connection, in view of the miniaturization of electric apparatuses, compact iron cores have also been desired. In order to respond to these desires, non-oriented magnetic steel sheets, primarily used as materials for iron cores for use in electric apparatuses, are required to have a low iron loss and increased efficiency.

Conventionally, in order to reduce iron loss of non-oriented magnetic steel sheets, methods for increasing the content of silicon (Si), aluminum (Al), manganese (Mn), and the like are generally employed. These methods have as an object to decrease eddy-current loss by increasing electric resistance in a steel sheet. However, in these methods, non-magnetic components are increased, and as a result, there is a problem in that a decrease in magnetic flux density cannot be avoided.

A method is also known in which, in addition to an increase of the content of Si or Al, the content of carbon (C) and/or sulfur (S) is decreased, and an alloy component such as boron (B) or nickel (Ni) is increased. The addition of B is disclosed in Japanese Unexamined Patent Application Publication No. 58-15,143. The addition of Ni is disclosed in Japanese Unexamined Patent Application Publication No. 3-281,758. In the methods in which an alloy component is added, iron loss is improved, but improvement in magnetic flux density is not significant. In addition, in the methods described above, workability of a steel sheet is degraded since hardness thereof is increased concomitant with an increase in the content of alloy component. As a result, a non-oriented magnetic steel sheet cannot be fabricated for use in electric apparatuses in some cases. Accordingly, the applications thereof are very limited, and hence, broad application of the steel sheets is difficult.

There is another method for improving magnetic properties in which the degree of crystallographic directional concentration (texture of the steel sheet) is improved by changing a manufacturing process. For example, in Japanese Unexamined Patent Application Publication No. 58-181,822, a method is disclosed in which a steel containing 2.8 to 4.0 weight % Si and 0.3 to 2.0 weight % Al is hot-rolled in the range from 200 to 500° C. so as to grow in the {100}<UVW> direction. In Japanese 10 Unexamined Patent Application Publication No. 3-294,422, a method is disclosed in which a steel containing 1.5 to 4.0 weight % Si and 0.1 to 2.0 weight % Al is hot-rolled, is annealed between 1,000 to 1,200° C., and is then cold-rolled with the reduction in thickness of 80 to 90% so as to grow in the {100}<UVW> direction. However, the improvement in magnetic properties by these methods described above is not significant. For example, in example 2 of Japanese Unexamined Patent Application Publication No. 58-181,822, the magnetic flux density and iron loss of a 0.35 mm-thick finished steel sheet, which contains 3.4 weight % Si, and 0.60 weight % Al, are 1.70 T of $B_{50}$ and 2.1 W/kg of $W_{15/50}$, respectively. In Japanese Unexamined Patent Application Publication No. 3-294,422, the magnetic flux density and iron loss of a 0.50 mm-thick finished steel sheet, which contains 3.0 weight % Si, 0.30 weight % Al, and 0.20 weight % Mn, are 1.71 T of $B_{50}$ and 2.5 W/kg of $W_{15/50}$, respectively.

In addition, there have been proposals to change the manufacturing process. However, in every proposed technique, satisfactory finished steel sheets having a low iron loss and a high magnetic flux density have not been obtained.

SUMMARY OF THE INVENTION

Objects of the present invention are to provide a non-oriented magnetic steel sheet having magnetic properties, such as a low iron loss and a high magnetic flux density, which are far superior to those obtained by conventional techniques, and to provide a manufacturing method therefor.

In order to realize a non-oriented magnetic steel sheet having a low iron loss and a high magnetic flux density at the same time, the inventors of the present invention performed intensive research on the problems in the conventional techniques. As a result, a novel non-oriented magnetic steel sheet and a manufacturing method therefor were developed.

A non-oriented magnetic steel sheet having a low iron loss and a high magnetic flux density, according to the present invention, comprises from about 1.5 to about 8.0 weight % Si, from about 0.005 to about 2.50 weight % Mn, and not more than about 50 ppm each of carbon (C), sulfur (S), nitrogen (N), oxygen (O), and boron (B), wherein a parameter <Γ> of a crystal orientation represented by an equation (1) is about 0.200 or less, $$\langle\Gamma\rangle = \sum_{j=1}^{n} V_j \sum_{i=1}^{m} (u_{ij}^2 v_{ij}^2 + v_{ij}^2 w_{ij}^2 + w_{ij}^2 u_{ij}^2)/m, \tag{1}$$

in which $(u_{ij}, v_{ij}, w_{ij})$ is an ith vector (i=1,2, . . . m; j=1, 2, . . . n; $u_{ij}^2+v_{ij}^2+w_{ij}^2=1$) which is obtained from a crystal grain j having a crystal orientation represented by (hkl)<uvw>, and which is parallel to a direction inclined 90×i/(m−1) degrees on a rolled surface from a rolled direction to a direction perpendicular thereto, and $V_j$ is an areal ratio of the crystal grain J to the total area of measured crystal grains.

In the non-oriented magnetic steel sheet having a low iron loss and a high magnetic flux density, according to the present invention, an average crystal grain diameter is preferably from about 50 to about 500 μm, and an areal ratio of crystal grains on a surface of the steel sheet is preferably about 20% or less, in which crystal plane orientations of the crystal grains are within 15° from the <111> axis. In addition, in the non-oriented magnetic steel according to the present invention, from about 0.0010 to about 0.10 weight % Al is preferably present, the <Γ> is preferably about 0.195 or less, and from about 0.01 to about 0.50 weight % antimony (Sb) is also preferably present. Furthermore, at least one member selected from the group consisting of from about 0.01 to about 3.50 weight % nickel (Ni), from about 0.01 to about 1.50 weight % tin (Sn), from about 0.01 to about 1.50 weight % copper (Cu), from about 0.005 to about 0.50 weight % phosphorus (P), and from about 0.01 to about 1.50 weight % chromium (Cr) is preferably contained in the non-oriented magnetic steel according to the present invention.

A method for manufacturing a non-oriented magnetic steel sheet having a low iron loss and a high magnetic flux density, according to the present invention, comprises steps of preparing a molten steel containing from about 1.5 to about 8.0 weight % Si, from about 0.005 to about 2.50 weight % Mn, and not more than about 50 ppm each of S, N, O, and B, a forming step of forming a slab from the molten steel, hot rolling the slab, annealing the hot-rolled steel sheet, cold rolling comprising a step of cold rolling the annealed steel sheet one time or a step of cold rolling the annealed steel sheet at least two times with an interim annealing step therebetween so as to have a final thickness, annealing the cold-rolled steel sheet for recrystallization, and optionally performing coating for insulation, wherein the carbon content is controlled to be about 50 ppm or less at the preparation of a molten steel or prior to annealing cold-rolled sheet and in annealing the hot-rolled sheet, said annealing is performed in a temperature range from about 800 to about 1,200° C. and the temperature is subsequently decreased from about 800 to about 400° C. at a rate of from about 5 to about 80° C./second. In the method for manufacturing a non-oriented magnetic steel sheet according to present invention, in annealing cold-rolled sheet, the rate of increase in temperature is preferably set to be about 100° C./hour or less in a range of from about 700° C. and above so that the temperature reaches a range from about 750 to about 1,200° C. It is also preferable that, in annealing cold-rolled sheet, the rate of increase in temperature be set to be about 2° C./second or more in a range from about 500 to about 700° C., the temperature be increased to about 700° C. or above so as to complete recrystallization of the steel sheet, the temperature be then decreased to a range of about 700° C. and below and again increased, and subsequently the rate of increase in temperature be set to be about 100° C./hour or less in the range of from about 700° C. and above so that the temperature reaches a range from about 750 to about 1,200° C. In the method for manufacturing a non-oriented magnetic steel sheet according to the present invention, an average crystal grain diameter prior to final cold rolling is preferably set to be about 100 $\mu$m or more, and the final cold rolling is preferably performed at from about 150 to about 350° C. in at least one pass thereof. In addition, the molten steel may further comprise from about 0.0010 to about 0.10 weight % Al, and from about 0.01 to about 0.50 weight % Sb. Furthermore, the molten steel preferably further comprises at least one member selected from the group consisting of from about 0.01 to about 3.50 weight % Ni, from about 0.01 to about 1.50 weight % Sn, from about 0.01 to about 1.50 weight % Cu, from about 0.005 to about 0.50 weight % P, and from about 0.01 to about 1.50 weight % Cr.

DESCRIPTION OF THE PREFERRED EMBODIMENTS

Through intensive research by the inventors of the present invention in order to develop techniques superior to conventional ones for improving magnetic properties of conventional non-oriented magnetic steel sheets having a high silicon content, it was discovered that magnetic properties could be significantly improved by properly controlling the orientation of crystal grains forming a steel sheet. In particular, it was first discovered that <Γ> was advantageously exploited as an index for controlling crystal orientations. In addition, in order to realize an appropriate use of the <Γ>, annealing conditions for a hot-rolled steel sheet and for recrystallization were examined, and as a result, specifically advantageous conditions were found.

The parameter <Γ> of crystal orientation determined by the equation (1) can be obtained by the method described below.

Orientations of individual crystal grains on a surface of a rolled steel sheet are measured using, for example, an electron backscattering pattern (hereinafter referred to as an EBSP). The orientation of a crystal grain is represented by (hkl)<uvw>. The (hkl) represents Miller indices of a measured crystal grain on the surface of the rolled steel sheet. In addition, a vector (u, v, w) is parallel to the rolled direction of the measured crystal grain.

Figure 1:
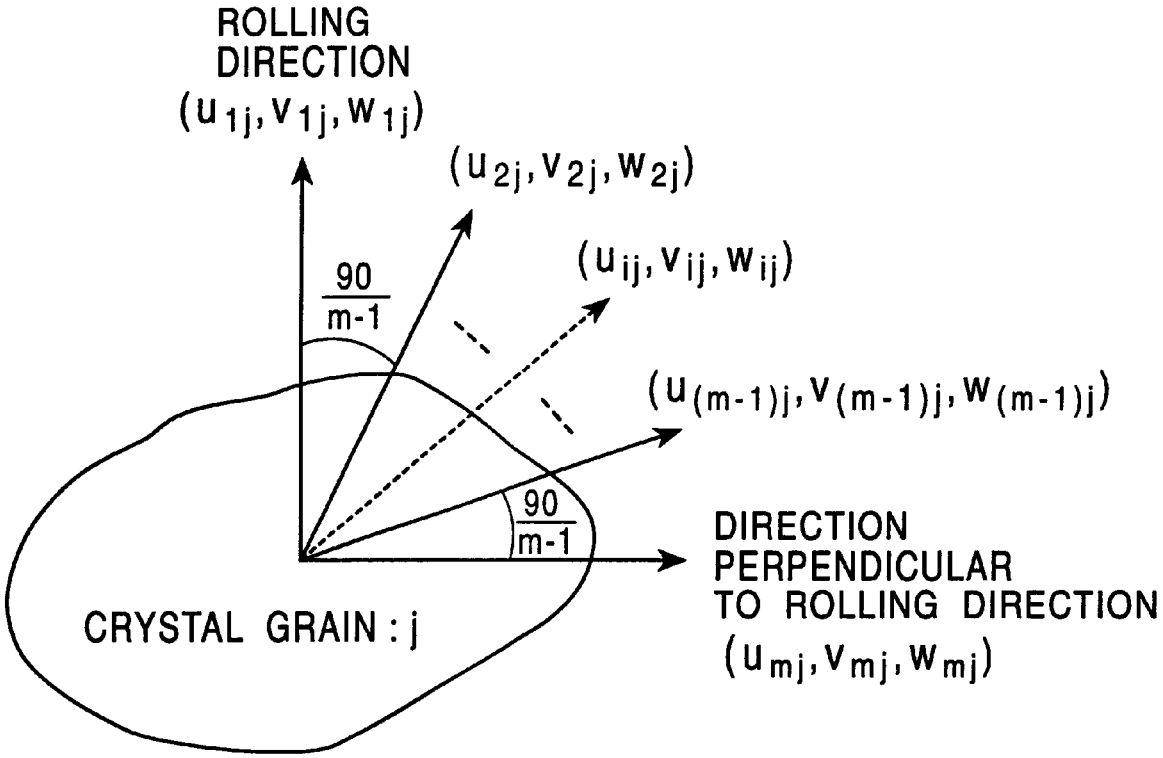
FIG. 1 is an illustration of a vector ($u_{ij}$, $v_{ij}$, $w_{ij}$) that is required for calculating a <Γ>.

A unit vector ith ($u_{ij}$, $v_{ij}$, $w_{ij}$) of a crystal grain j, which is between the rolled direction on the surface of the steel sheet and the direction perpendicular thereto, is obtained as shown in FIG. 1. When an orientation of the crystal grain j is (hkl)<uvw>, the ($u_{lj}$, $v_{lj}$, $w_{lj}$) coincides with a unit vector (u, v, w)/($u^2+v^2+w^2$) in the rolled direction. A ($u_{mj}$, $v_{mj}$, $w_{mj}$) coincides with a unit vector in the direction perpendicular to the rolled direction.

Next, $\Gamma_{ij}=u_{ij}^2v_{ij}^2+v_{ij}^2w_{ij}^2+w_{ij}^2u_{ij}^2$, which is equation 2, is calculated. The $\Gamma_{ij}$s are preferably calculated for each crystal grain at least in seven directions at every 15° interval from the rolled direction to the direction perpendicular thereto. An in-plane average, $\Sigma\Gamma_{ij}/m$ is calculated from the $\Gamma_{ij}$s obtained in respective directions of each crystal grain on the rolled surface.

Furthermore, the summation of in-plane average of $\Gamma_{ij}$ weighed with each areal ratio ($V_j$) for n numbers of crystal grains is represented by <Γ>. That is, the <Γ> is represented by the following equation.

$$\langle\Gamma\rangle = \sum_{j=1}^{n} V_j \sum_{i=1}^{m} \Gamma_{ij}/m = \sum_{j=1}^{n} V_j \sum_{i=1}^{m} (u_{ij}^2 v_{ij}^2 + v_{ij}^2 w_{ij}^2 + w_{ij}^2 u_{ij}^2)/m$$

In this connection, in order to obtain a meaningful statistical value, it is preferable that one thousand or more crystal grains be measured.

Figure 3:
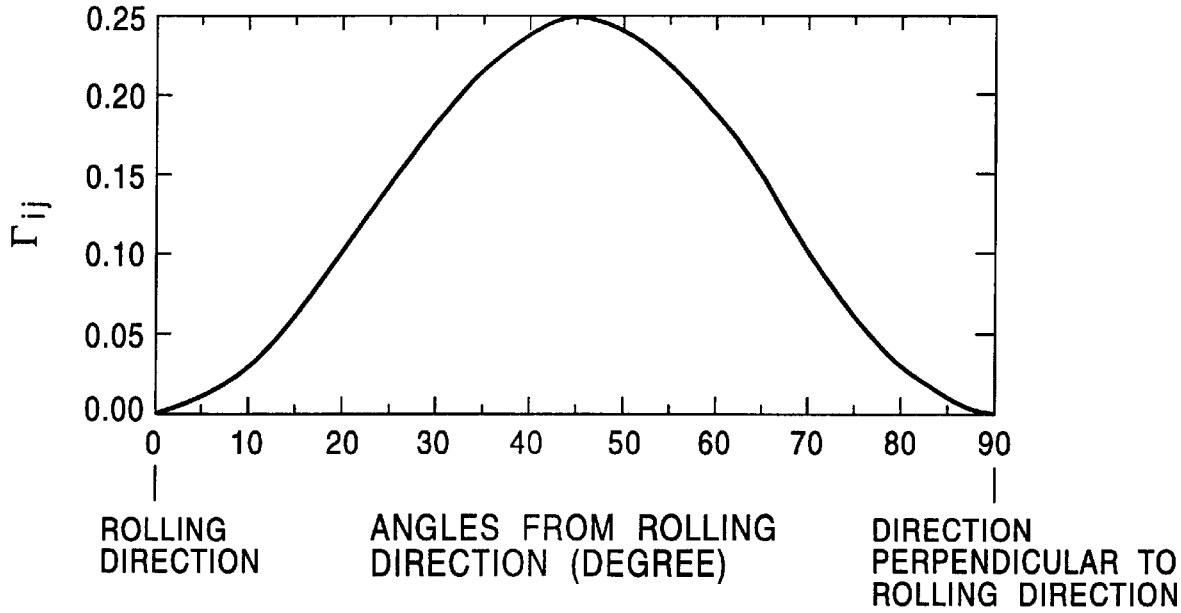
FIG. 3 is a graph showing $\Gamma_{ij}$ of the {100}<001> crystal grain at angles from a rolled direction to a direction perpendicular thereto.

The $\Gamma_{ij}$ determining the <Γ> is an intrinsic value in the crystal orientation. For example, concerning the crystal grain having a regular cubic orientation {100}<001>, the results of the $\Gamma_{ij}$s calculated over a range of directional angles are shown in FIG. 3. Since a unit vector of the crystal grain having a regular cubic orientation in the rolled direction is (0, 0, 1), the $\Gamma_{ij}$ is zero. Since a unit vector in the direction perpendicular to the rolled direction is (0, 1, 0), the $\Gamma_{ij}$ is zero. Since a unit vector in the direction inclined 45° from the rolled direction is 1/√2(0, 1, 1), the $\Gamma_{ij}$ is 0.25, and it is the maximum value.

In addition, the <Γ> can also be obtained by calculating an orientation distribution function (ODF) of crystal projection data measured by X-ray diffraction. That is, from the results obtained by the ODF, a volume percentage of a crystal grain provided with a crystalline plane having specific Miller indices in the specific direction of a steel sheet can be calculated. If a volume percentage is supposed as an areal ratio, the volume percentage is multiplied with the $\Gamma_{ij}$ determined by the Miller indices, and the products thus obtained for individual Miller indices are added together from the rolled direction to the direction perpendicular thereto in a plane, whereby the average of the values thus obtained is <Γ>.

Hereinafter, experimental results that were obtained by using the present invention will be described in detail.

First, an experiment on the influence of aluminum (Al) and antimony (Sb) was performed. A steel ingot group A having various Al contents was formed, in which 3.5 weight % Si, and 0.10 weight % Mn were contained, and the contents of carbon (C), sulfur (S), nitrogen (N), and boron (B) were respectively reduced to 20 ppm or less. A steel ingot group B was formed by adding 0.04 weight % Sb to the steel ingot group A. These ingots were heated to 1,040° C. and were hot-rolled so as to be 2.3 mm thick. The hot-rolled sheets were annealed at 1,075° C. for 5 minutes and were then cooled from 800 to 400° C. at a cooling rate of 20° C./second. Pickling was performed for the annealed hot-rolled sheets, and cold rolling was then performed at 250° C., thereby obtaining steel sheets having a final thickness of 0.35 mm. The cold-rolled sheets were heated at a rate of 12° C./second from 500 to 700° C. and were then annealed for recrystallization at 1,050° C. for 10 minutes, whereby finished steel sheets were obtained. Ring samples 100 mm in inner diameter and 150 mm in outer diameter were cut from the finished steel sheets, and the magnetic flux densities $B_{50}$ (T) and the iron losses $W_{15/50}$ (W/kg) were measured.

Figure 2A:
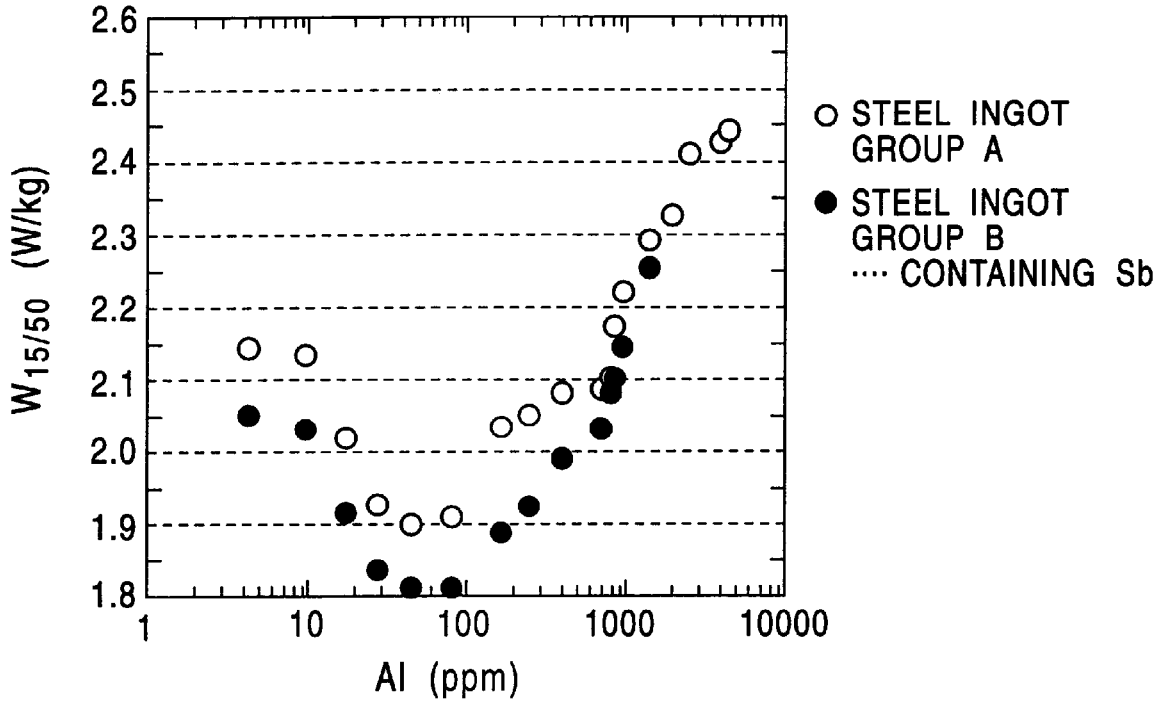
FIGS. 2A and 2B are graphs showing the influence of the Al content on the iron loss and magnetic flux density, respectively.
Figure 2B:
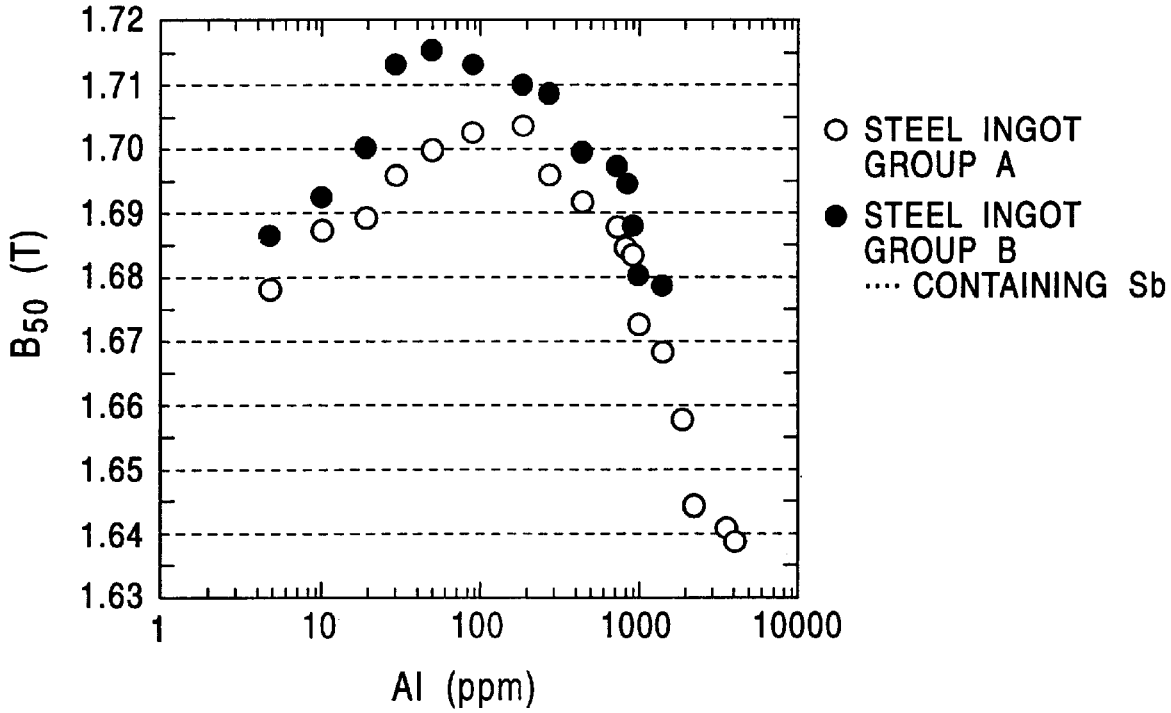

In FIGS. 2A and 2B, the influence of the Al content in an ingot on the iron loss and the magnetic flux density in the finished sheet are shown, respectively. As shown in FIGS. 2A and 2B, the magnetic properties significantly vary in accordance with the content of Al in the ingot. When the Al content is from about 0.0010 weight % to about 0.10 weight %, superior results were obtained in which the $B_{50}$ was 1.68 T or more, and the $W_{15/50}$ was 2.1 W/kg or less. In particular, when the Al content is from about 0.005 weight % to about 0.020 weight %, significantly superior results were obtained in which the $B_{50}$ was 1.70 T or more, and the $W_{15/50}$ was 1.9 W/kg or less. Concerning the steel ingot group B, to which was added Sb, significant improvements in magnetic properties were observed.

In order to find out why the superior magnetic properties were obtained in this experiment, crystal grain diameters of the individual finished sheets were examined. In non-oriented magnetic steel sheets, when the diameters of the crystal grains of the finished sheet are increased, the iron loss is generally improved. In this connection, the crystal grain diameters are influenced by behavior in grain growth during annealing for recrystallization. In this experiment, the influence of the Al content and the addition of Sb on the diameters of the crystal grains in the finished sheets were not significant, and the grain diameters in these steel sheets were from about 200 to about 300 μm. That is, the magnetic properties and the behavior of grain growth during annealing for recrystallization were nearly unrelated.

Consequently, the improvement in magnetic properties in the range of the Al content from about 0.0010 to about 0.10 weight % and the further improvement in the magnetic properties by addition of Sb were considered to be due to improvement in crystal orientations. Hence, measurement of the crystal grain orientations in the finished sheet was performed by using an EBSP. In this measurement, approximately 2,000 crystal grains in an area 10 mm by 10 mm on the surface of the steel sheet were measured.

In this measurement, the inventors of the present invention used the newly developed <Γ> for examination. As a result, it was discovered that there was a significant relationship between the <Γ> and the magnetic flux density.

Based on the measured results on individual orientations of approximately 2,000 crystal grains on the surface of the finished sheet, the $\Gamma_{ij}$s defined by the equation (2) in the direction J of interest (for example, a rolled direction) were calculated, and the weighted average in accordance with grain areas was then calculated, thereby obtaining the Γ(J). When the relationship between the Γ(J) and the magnetic flux density in the direction J was examined, a significantly close relationship was discovered. In addition, research on the intensive ratio I{100}/I{111} of the {100} intensity (hereinafter referred to as I{100}) to the {111} intensity (hereinafter referred to as I{111}) by an X-ray diffraction method, which has been commonly used, was performed as a comparison. In this connection, I{100}/I{111} is an evaluation method for a texture disclosed in Japanese Unexamined Patent Application Publication No. 8-134,606.

Figure 4:
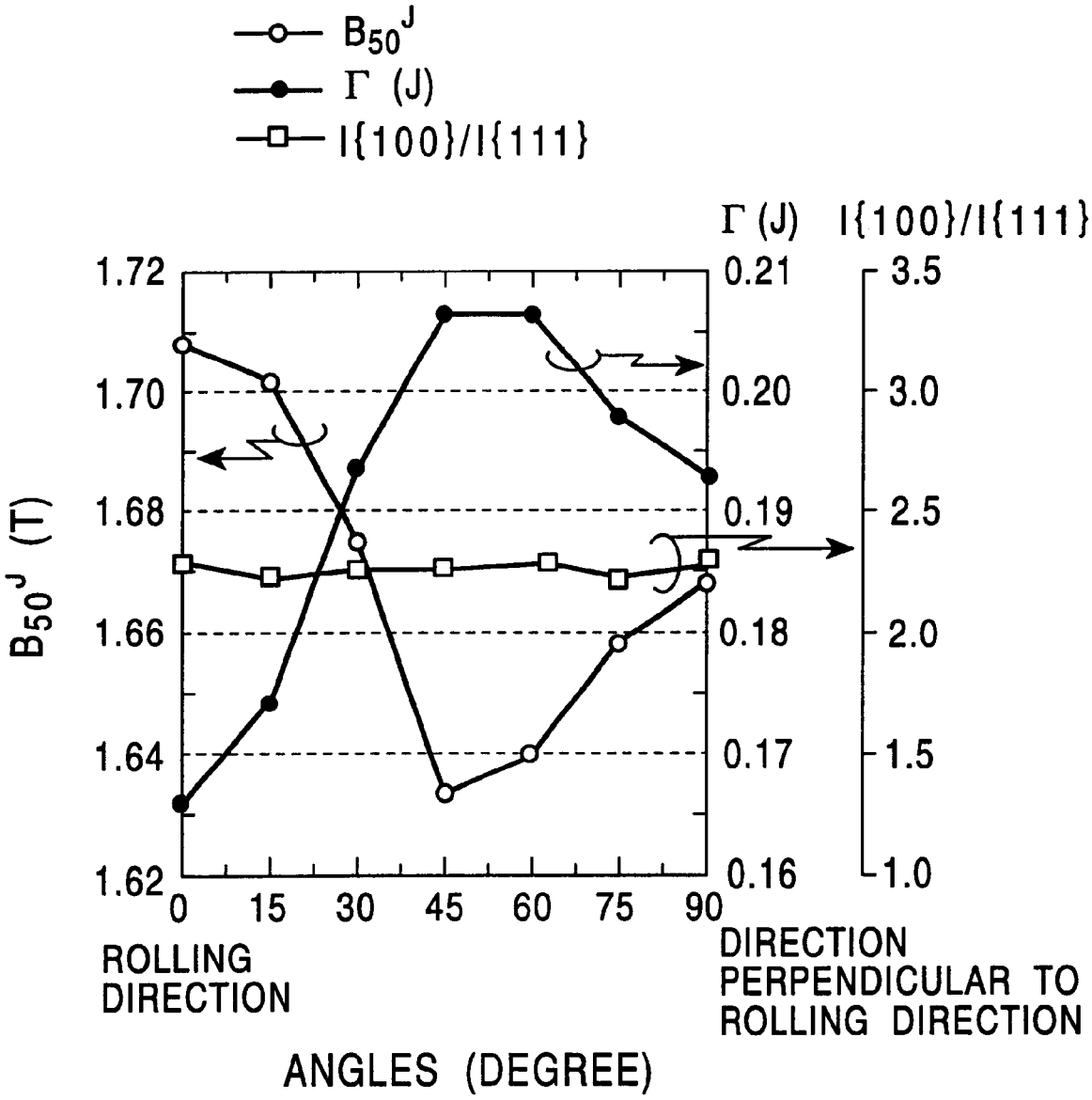
FIG. 4 is a graph showing $B_{50}^{J}$, Γ(J), and I{100}/I{111} at angles of a finished steel sheet from a rolled direction to a direction perpendicular thereto.
Figure 5:
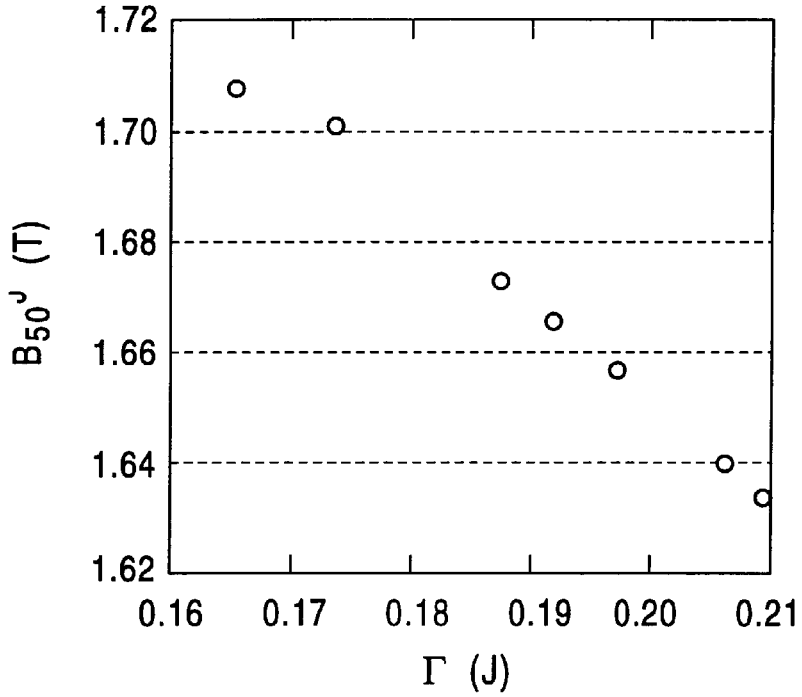
FIG. 5 is a graph showing the relationship between the magnetic flux density ($B_{50}^{J}$) and the Γ(J) of a finished steel sheet.

The magnetic flux densities of the finished sheet containing 0.01 weight % Al in the steel ingot group A were measured in various directions from the rolled direction (0°) to the direction perpendicular thereto (90°). Epstein samples were cut from the finished sheet at every 15° interval from the rolled direction (0°) to the direction perpendicular thereto (90°), and the magnetic properties were then measured. In FIG. 4, variation of $B_{50}^J$ and Γ(J) versus the direction is shown. As shown in FIG. 4, $B_{50}^J$ and Γ(J) varied with direction. In addition, in FIG. 5, the relationship between the $B_{50}^J$ and the Γ(J) is shown. As shown in FIG.

5, it was understood that there was a close relationship between $B_{50}^{J}$ and Γ(J).

In FIG. 4, the values of I{100}/I{111} are also shown. Since the value of I{100}/I{111} is correlated with the plane intensity, the values thereof were almost constant in each direction as shown in FIG. 4, and it was understood that the values of I{100}/I{111} were not varied in accordance with the change in magnetic flux density.

Subsequently, for finished sheets of each ingot, measurement of crystal grain orientation and X-ray diffraction analysis were performed, and the relationships between measurement results of magnetic flux density in the ring sample and the average value of Γ(J) and I{100}/I{111} in the rolled plane were examined. In this connection, <Γ> is an average of Γ(J)s obtained at every 15° interval from the rolled direction (0°) to the direction perpendicular thereto (90°) using the measured data at each crystal grain orientation.

Figure 6:
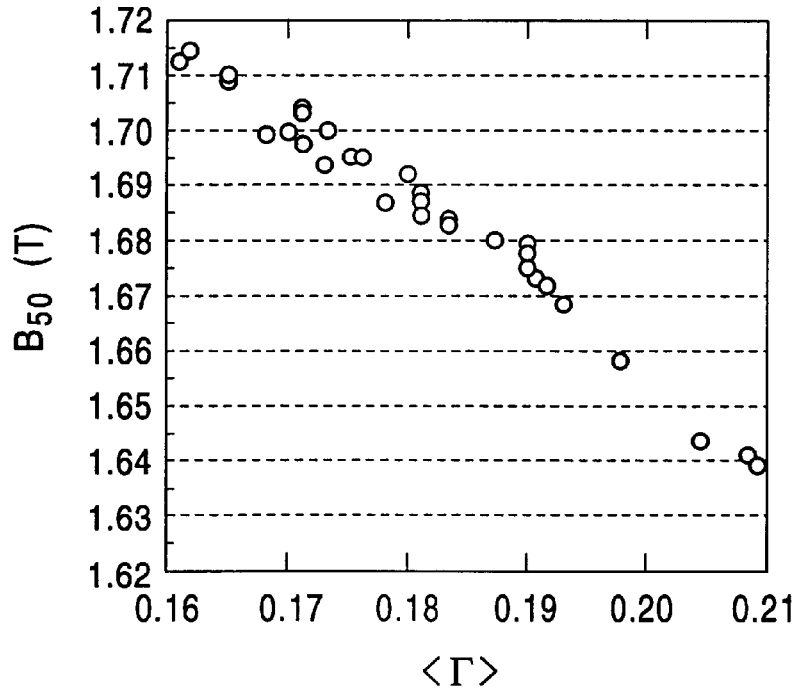
FIG. 6 is a graph showing the relationship between the magnetic flux density in an ring sample of a finished steel sheet and <Γ>, the average Γ(J) in a plane obtained by measurement for crystal grain orientations.
Figure 7:
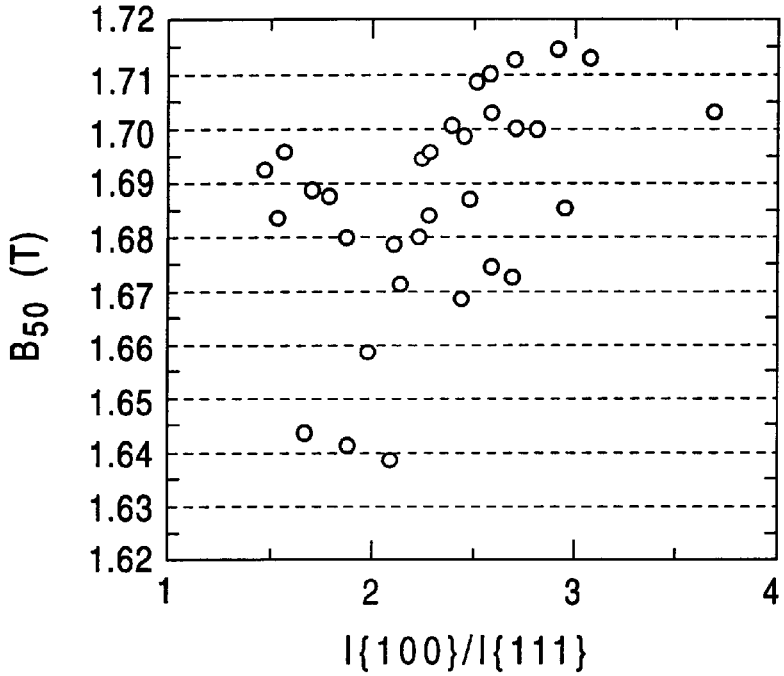
FIG. 7 is a graph showing the relationship between the magnetic flux density in an ring sample of a finished steel sheet and the I{100}/I{111}.

In FIG. 6, the relationship between the magnetic flux density in the ring sample of the finished steel sheet and <Γ>, the average of Γ(J) in the plane obtained from the measurement of crystal grain orientations is shown. There was a close relationship between the magnetic flux density and <Γ>. It was understood that in order to obtain a high magnetic density, such as $B_{50}$>1.65 T, the <Γ> must be about 0.200 or less. In FIG. 7, the relationship between the I{100}/I{111} and the magnetic flux density in the ring sample of the finished sheet is shown, which were obtained from the same sample as described above. The distinct relationship therebetween was not seen. The reason for the results thus obtained was not clearly understood, but the following may be hypothesized. In the measurement for I{100}/I{111}, the intensity of the crystal grain on only a very limited part of the crystal plane in the vicinity of {111} or {100} was measured. That is, the influence of intensities of crystal grains on many orientation planes, which are relatively critical crystal planes other than those mentioned above, such as {544}, {221}, {332}, and the like, on the magnetic properties was excluded. On the other hand, in the measurement method of the present invention, the Γ(J) in each direction of the steel sheet was obtained directly from the orientation of each crystal grain, and the average value in the plane was calculated from the values thus obtained. That is, it was believed to be that since the crystal grains having critical crystal planes were not excluded, superior result was obtained.

There is another advantage in the use of <Γ>. Generally, in accordance with the content of an element other than iron, the saturation flux density of a steel sheet varies. Hence, even when finished sheets have crystal grains having the same degree of crystallographic directional concentration, the magnetic flux densities thereof differ from each other. Accordingly, when the degrees of crystallographic directional concentration in finished sheets having different compositions from each other are compared, the comparison cannot simply be performed by the values of magnetic flux densities therebetween. However, since the <Γ> was only determined by the crystal grain orientation, the degree of crystallographic directional concentration of crystal grain orientation in the finished sheet can be evaluated, regardless of alloy components. As described above, the <Γ> is a significantly effective index.

Next, examination on the relationship between the content of Al and the content of impurities will be described.

As steel ingot group B (in the range of the present invention), ingots were formed having various Al contents, in which 3.5 weight % Si, 0.10 weight % Mn, and 0.03 weight % Sb were contained therein, and the contents of C, S, N, O, and B were respectively reduced to about 50 ppm or less. In addition, as a steel ingot group C (outside the scope of the present invention), ingots were formed having various Al contents, in which 3.5 weight % Si and 0.12 weight % Mn were contained therein, and the contents of C, S, N, O, and B were respectively 50 ppm or more and the total content thereof was 350 ppm or more. These ingots were heated to 1,100° C. and were hot-rolled so as to be 2.4 mm thick. Next, the hot-rolled sheets were annealed at 1,100° C. for 5 minutes and were then cooled from 800 to 400° C. at a cooling rate of 15° C./second. Pickling was performed for the annealed hot-rolled sheets, and cold rolling was then performed at 200° C., thereby obtaining steel sheets having a final thickness of 0.35 mm. The cold-rolled sheets were annealed for recrystallization at 1,050° C. for 10 minutes, whereby finished steel sheets were obtained. Measurement of crystal grain orientations in the finished steel sheet thus obtained was performed by an EBSP using approximately 2,000 crystal grains in an area 10 mm by 10 mm on the surface of the finished sheet. From the result obtained by the method described above, <Γ>, the average in the rolled plane was obtained.

Figure 8:
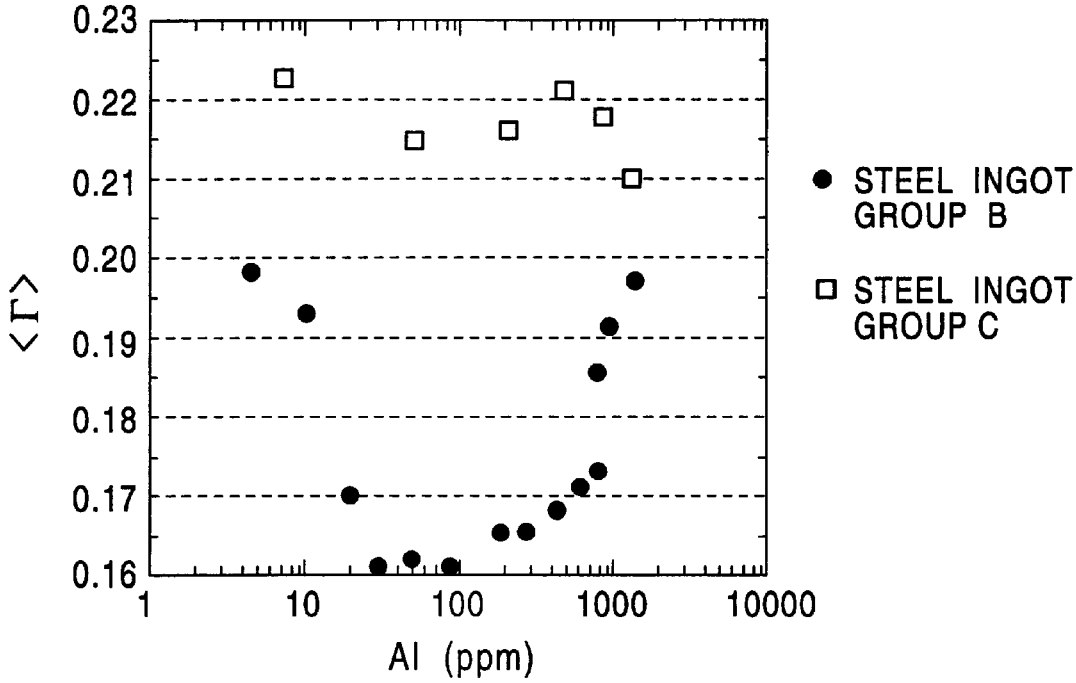
FIG. 8 is a graph showing the influence of the Al content in a starting material on a <Γ> of a finished steel sheet.

In FIG. 8, the relationship between the Al content and the <Γ> in each steel ingot group was shown. In the steel ingot group B in which the impurity contents of C, S, N, O, and B were reduced, the <Γ> was 0.200 or less. On the other hand, in the steel ingot group C in which the impurity contents of C, S, N, O, and B were relatively high, the <Γ> exceeded 0.200. In addition, in the steel ingot group B, when the content of Al ranged from 10 to 1,000 ppm, the <Γ> was 0.195 or less, whereby it is particularly advantageous for improving magnetic flux density.

Based on the experimental results described above, intensive research by the inventors of the present invention was performed, and as a result, it was discovered that, in order to obtain a significantly superior texture in which magnetic flux density can be advantageously improved since the <Γ> was 0.195 or less, the Al content is not only controlled, but also, the impurities C, S, N, O, and B must be reduced to about 50 ppm or less, respectively.

Conventionally, in order to improve iron loss, methods for increasing intrinsic electric resistance were generally employed for a high quality non-oriented magnetic steel sheet having a high Si content. In addition, the method for increasing intrinsic resistance also has an effect of facilitating grain growth in the crystal grains. The reason for this is believed to be that aluminum nitride (AlN), which suppresses crystal grain growth, is enlarged by agglomeration. In order to obtain the effect of suppressing the crystal grain growth, a certain amount of Al must be contained. Conventionally, the content of Al is controlled to be always greater than 0.1 weight %, and generally, the content thereof is approximately 0.4 to 1.0 weight %. However, according to the results obtained by the inventors of the present invention from the experiments, a texture was most preferably grown in the Al content range from about 0.0010 to about 0.10 weight %. As a result, the <Γ> was 0.195 or less, and hence, the magnetic flux density and the iron loss also showed the best values. The Al content range described above was considerably lower than that of a conventional technique.

As described above, it was understood that, when the impurities C, S, N, O, and B contained in the starting material were respectively reduced to about 50 ppm or less, and when the Al content was controlled, a superior texture having a low <Γ> can be grown. The reason for this was not clearly understood; however, the inventors of the present invention believe that crystal grain boundary migration suppressed by the impurities was relevant thereto. That is, the influence of the impurities is eliminated by purifying the starting material, so that grain boundary migration easily occurs. Among impurities, C, S, N, O, and B, which strongly segregate at grain boundaries were reduced, and hence, the effect described above was significant. In addition, when the Al content was reduced to be about 0.10 weight % or less, the arrangement of a crystal lattice similar to that of pure iron was formed. In this case, the fundamental mechanism, in which a difference in grain boundary migration rate depends on the structure of grain boundary, may work more distinctly. That is, in a process of grain growth during recrystallization, the migration rate only depends on the texture, and only a limited part of the boundaries is preferentially migrated. As a result, growth of a number of crystal grains having crystal planes, which are not preferable in magnetic properties, such as {111}, {554}, and {321}, are suppressed. That is, the texture changes toward the <Γ> being reduced, so that magnetic properties are improved.

Concerning the addition of Sb, a phenomenon was observed in which the crystal orientation having a plane in the vicinity of {100}, which is preferable in magnetic properties, preferentially recrystallized during growth of recrystallized nuclei. Hence, it is considered that the magnetic properties are significantly improved by the phenomenon described above together with the effect of Al reduction.

In addition, when the Al content was less than about 10 ppm, the improvement of magnetic properties by the reduction of impurities, C, S, N, O, and B Was lessened. In this case, it was observed that a larger silicon nitride was formed in the steel. It is believed to be that deformation behavior during cold rolling may be changed by the presence of the silicon nitride. Accordingly, it is also considered that the <Γ> in the steel after annealing for recrystallization may be increased to some extent. Hence, even though the <Γ> was decreased by the reduction of impurities, the improvement of the magnetic properties might be lessened as a result. On the other hand, when the Al content was 10 ppm or more, the growth of this large silicon nitride was suppressed. Accordingly, the increase of the <Γ> caused by the change in the deformation behavior during cold rolling, as described above, was avoided. That is, the reduction of the impurities, C, S, N, O, and B when the Al content was about 10 ppm and more was particularly advantageous in improving magnetic properties.

As described above, in order to make <Γ> to be about 0.200 or less, it is important to reduce the impurities C, S, N, O, and B, respectively, to 50 ppm or less. In addition, when the Al content is controlled to be from about 0.001 to about 0.10 weight %, and when a predetermined amount of Sb is contained, if necessary, the <Γ> can be reduced to 0.195 or less, and the magnetic properties can be further improved.

In this connection, in the method of the present invention for improving magnetic properties by improving texture without adding a large amount of Al, there is another advantage of high saturation flux density due to a small amount of alloy elements being added therein. In addition, since an increase in hardness is avoided, and hence, workability of a finished steel sheet is maintained, there is an advantage in facilitating the applications thereof to common electric products.

Furthermore, in order to provide another method in which <Γ>can be 0.200 or less by improving texture in addition to the component adjustment described above, experiments on annealing conditions for a hot-rolled sheet were performed.

A steel ingot was formed in which 3.6 weight % Si, 0.13 weight % Mn, 0.009 weight % Al, and 0.06 weight % Sb were contained, and C, S, N, O, and B were respectively reduced to 20 ppm or less. The ingot was heated to 1,120° C. and was hot-rolled so as to be 2.8 mm thick. Next, annealing for the hot-rolled sheet was performed at 1,100° C. for 5 minutes, and the annealed hot-rolled sheet was then cooled at various cooling rates. In addition, the annealed sheet was pickled and was cold-rolled at 230° C. so as to have a final thickness of 0.50 mm. Annealing for recrystallization was performed for the cold-rolled sheet at 1,070° C. for 10 seconds, thereby obtaining a finished steel sheet. From the finished steel sheet thus obtained, ring samples of 100 mm in inner diameter and 150 mm in outer diameter were cut, and then the magnetic flux densities and iron losses of the finished steel sheet were measured. In addition, crystal grain orientations of the finished steel sheet were measured for approximately 2,000 crystal grains in an area 10 mm by 10 mm by an EBSP. The <Γ> was obtained from the results.

Figure 9:
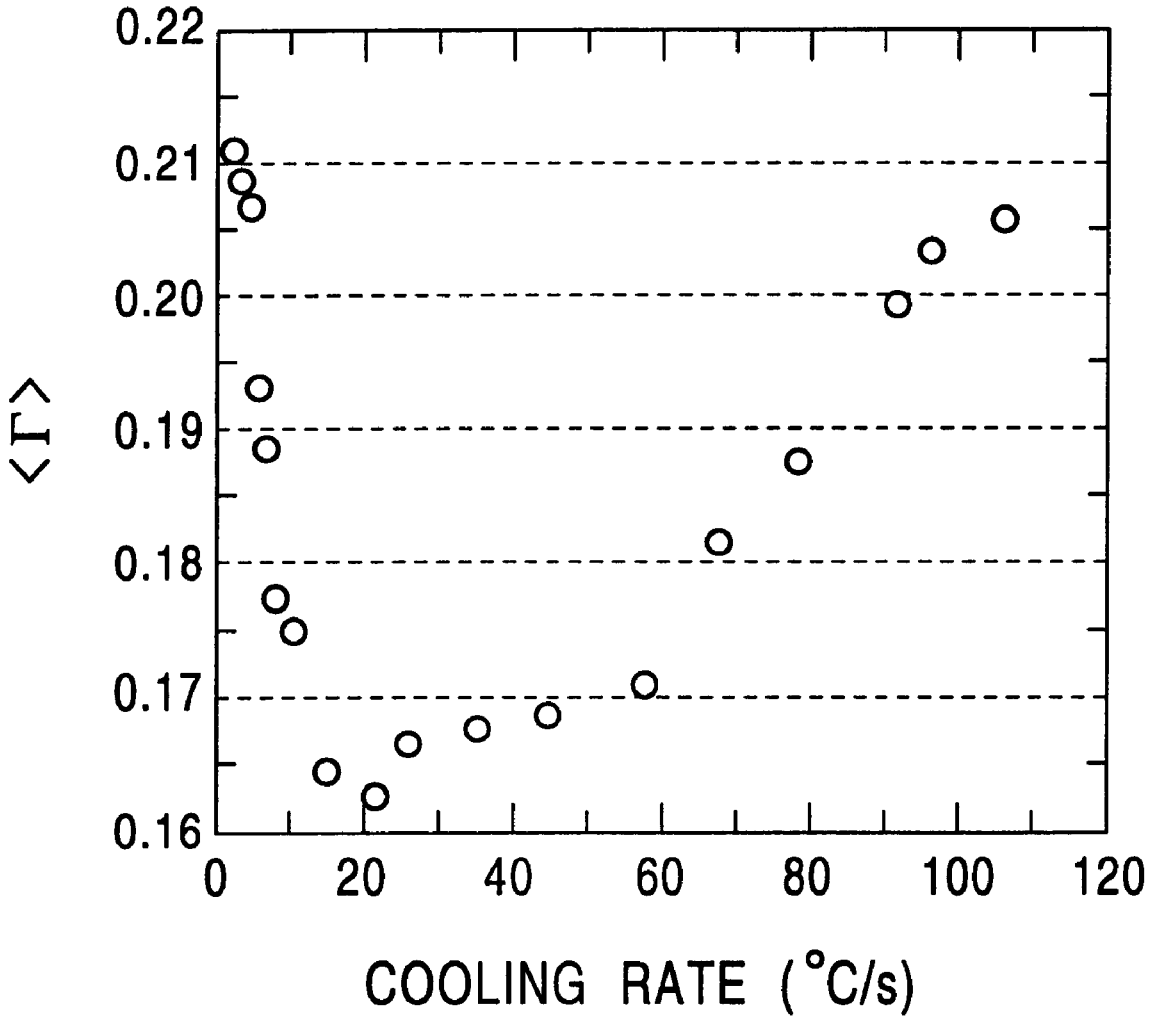
FIG. 9 is a graph showing the influence of a cooling rate after annealing for a hot-rolled steel sheet on a <Γ> of a finished steel sheet.

In FIG. 9, the relationship between the <Γ> and the cooling rate from 800 to 400° C. after annealing for a hot-rolled sheet is shown. When the cooling rate was set to be in the range between 5 to 80° C./second, a particularly superior texture having the <Γ> of 0.195 or less was obtained. Accordingly, it is believed to be that, when the cooling rate is controlled, trace Al precipitate is sparsely dispersed. As a result, a non-uniform deformation during cold rolling is facilitated, so that recrystallized texture may be improved. However, the fundamental mechanism of improvement in the texture is not clearly understood.

Next, in order to examine annealing conditions for recrystallization as a factor for further improving iron loss and magnetic flux density, the following experiments were performed.

As a steel ingot D, a steel ingot was formed in which 3.6 weight % Si, 0.13 weight % Mn, and 0.30 weight % Al were contained, and C, S, N, O, and B were respectively reduced to 20 ppm or less. In addition, as a steel ingot E, a steel ingot was formed in which 3.6 weight % Si, 0.13 weight % Mn, 0.009 weight % Al, and 0.06 weight % Sb were contained, and C, S, N, O, and B were respectively reduced to 20 ppm or less. The ingots were heated to 1,070° C. and were then hot-rolled so as to be 2.5 mm thick. Next, annealing for a hot-rolled sheet was performed at 1,170° C. for 5 minutes, and the annealed hot-rolled sheets were then cooled at 10° C./second from 800 to 400° C. In addition, the annealed sheets were pickled and were then cold-rolled at 200° C. so as to have a final thickness of 0.35 mm. From the cold-rolled sheets, samples were cut and were then annealed for recrystallization using three different sets of conditions, thereby obtaining finished steel sheets.

Annealing 1

Rate of increase in temperature:

average rate of 30° C./second from room temperature to 500° C., average rate of 15° C./second from 500 to 700° C., and average rate of 8° C./second from 700 to 900° C.

Conditions for soaking: 900° C. for 10 seconds

Cooling rate: average rate of 10° C./second from soaking temperature to room temperature Annealing atmosphere: 50% hydrogen and 50% nitrogen, and the dew point is −30° C.

Annealing 2

Rate of increase in temperature:

average rate of 100° C./hour from room temperature to 500° C., and average rate of 50° C./hour from 500 to 900° C.

Conditions for soaking: 900° C. for 10 hours

Cooling rate: an average rate of 100° C./hour from soaking temperature to room temperature Annealing atmosphere: Ar, the dew point is −30° C.

Annealing 3

Annealing 1 is performed, and Annealing 2 is subsequently performed.

From the finished steel sheets thus obtained, ring samples of 100 mm in inner diameter and 150 mm in outer diameter were cut, and then the magnetic flux densities and iron losses of the finished steel sheets were measured. In addition, crystal grain orientations of the finished steel sheet were measured for approximately 2,000 crystal grains in an area 10 mm by 10 mm on the surface of the finished steel sheet by an EBSP, whereby the <Γ> was obtained.

Figure 10:
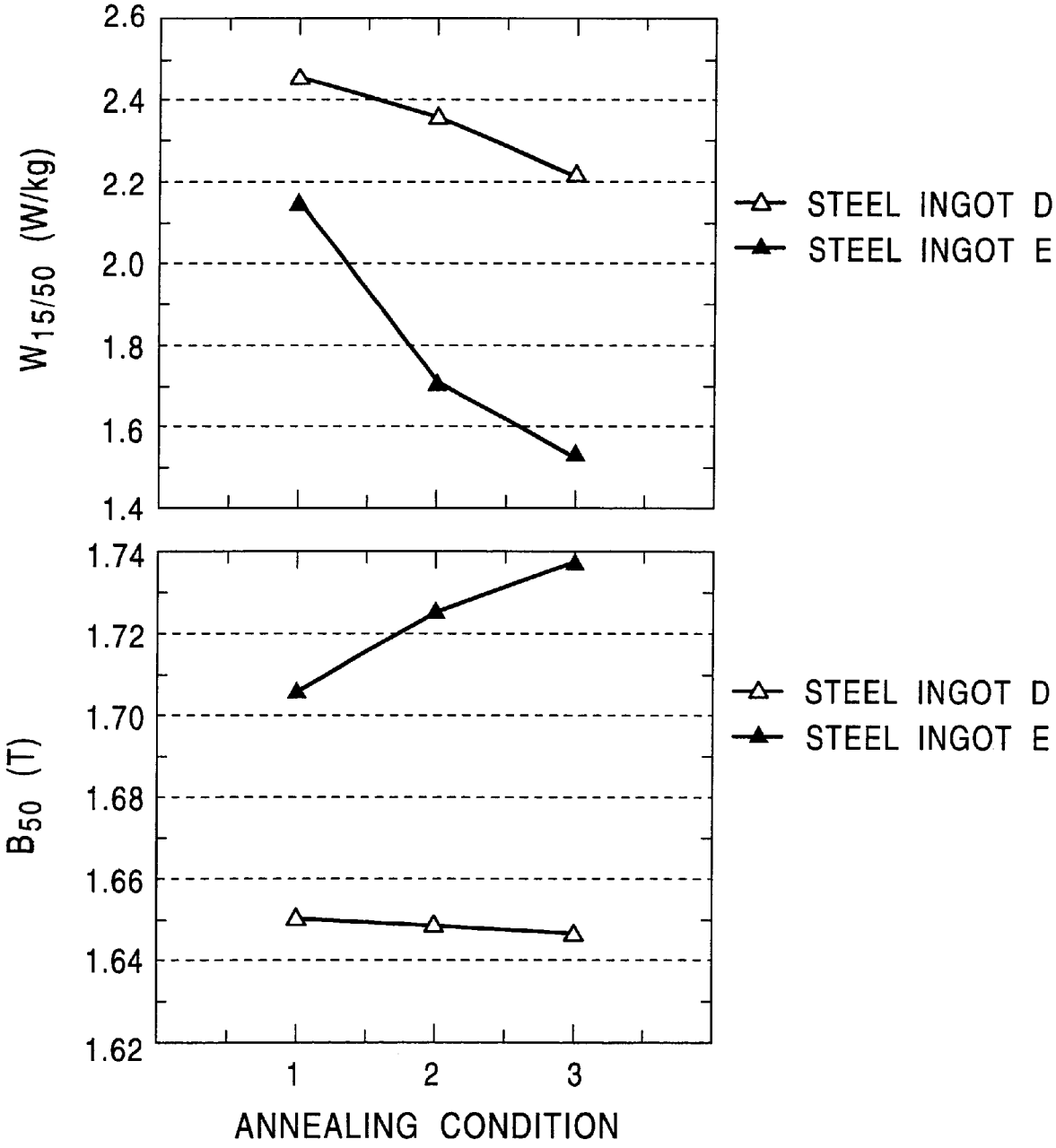
FIGS. 10A and 10B are graphs showing the influence of annealing condition for recrystallization on the iron loss and magnetic flux density of a finished steel sheet, respectively.
Figure 11:
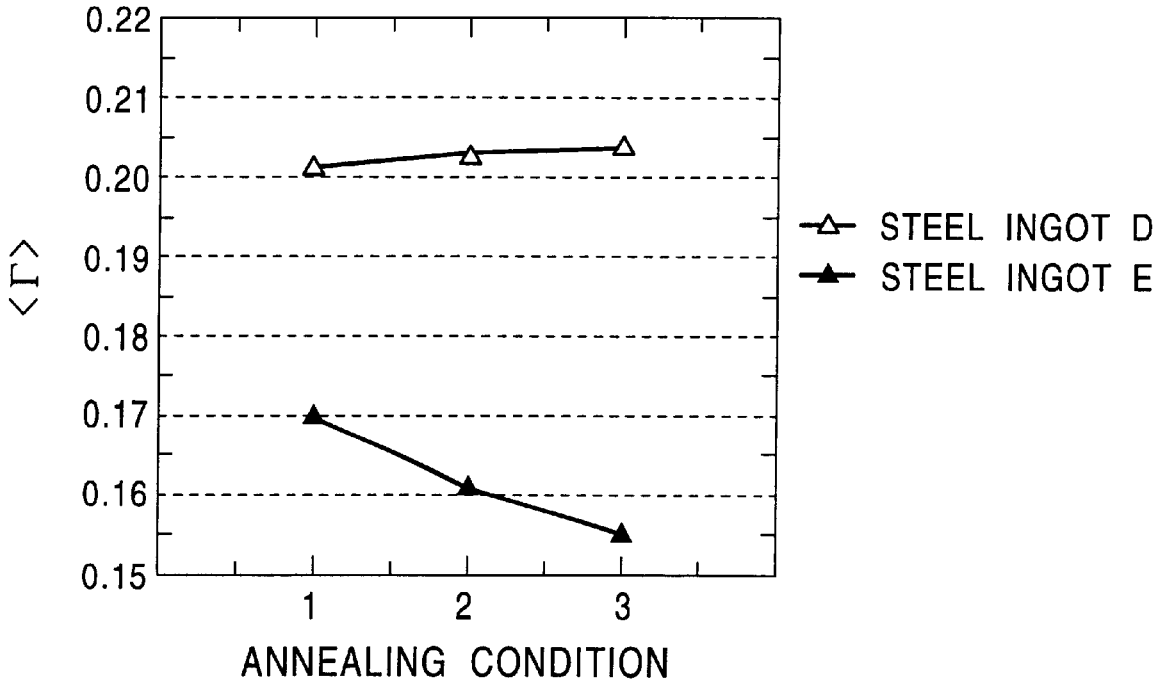
FIG. 11 is a graph showing the influence of annealing condition for recrystallization on a <Γ> of a finished steel sheet.

In FIGS. 10A and 10B, the relationships between the annealing conditions for recrystallization and the magnetic properties are shown. In addition, in FIG. 11, the relationship between the annealing conditions and the <Γ> is shown.

Concerning iron loss, for both steel ingots, the results obtained by Annealing 2 were superior to those by Annealing 1. In addition, the result obtained by Annealing 3 was better than those obtained by Annealing 1 and Annealing 2. Furthermore, the iron loss of the steel ingot E containing Sb was better than that of the steel ingot containing no Sb.

Concerning magnetic flux density, in the steel ingot E containing Al and Sb, the results obtained by Annealing 2 and Annealing 3 were better than that obtained by Annealing 1. However, the magnetic flux density of the steel ingot D containing 0.3 weight % of Al and no Sb was not changed. In addition, <Γ> varied in accordance with the variation in the magnetic flux density. In the steel ingot E, the lowest <Γ> and the highest magnetic flux density were obtained.

Figure 12:
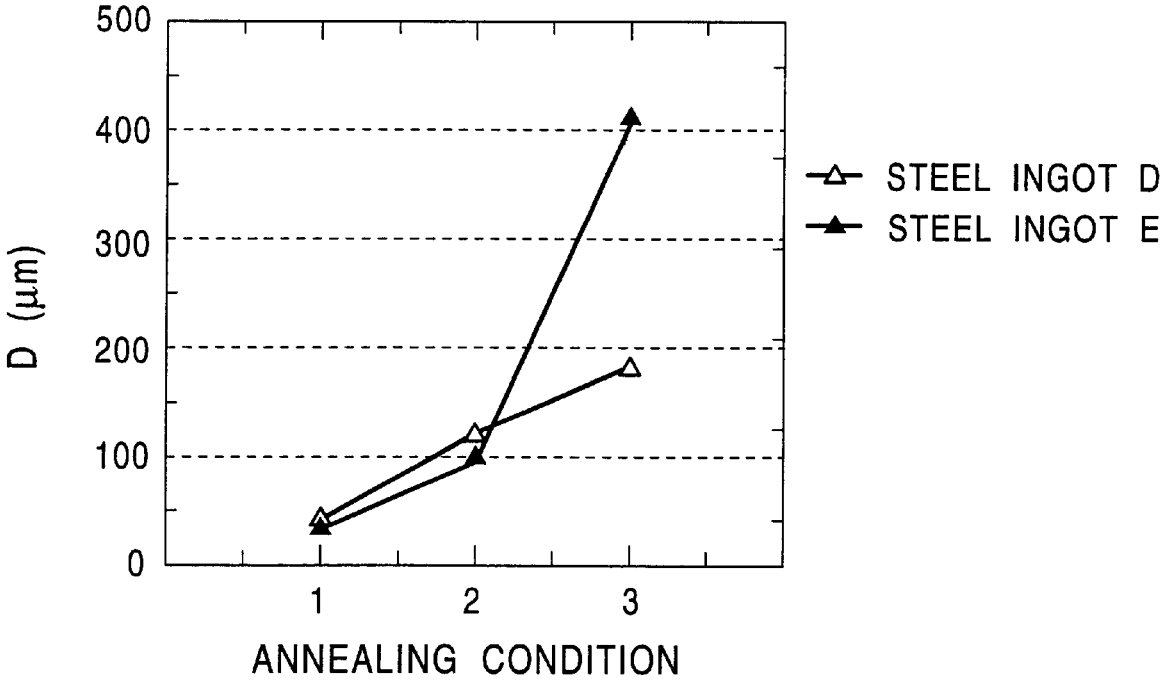
FIG. 12 is a graph showing the influence of annealing condition for recrystallization on the grain diameter of a finished steel sheet.

In FIG. 12, the relationship between the grain diameters after annealing for recrystallization and the annealing conditions is shown. As shown in FIG. 12, compared with the result obtained in Annealing 1 in which a rate of increase in temperature was high, the grain growth further progressed to some extent in Annealing 2 in which the rate of increase in temperature was slow. The maximum temperature reached in each annealing was the same, i.e., 900° C. In addition, the grain growth in Annealing 3, in which a temperature was rapidly increased and was then slowly cooled, further progressed than those in Annealing 1 and Annealing 2. In particular, the grain growth in the steel ingot E was significant. In Annealing 2, even though the maximum temperature was equal to that in Annealing 1 in which the rate of increase in temperature was high, the soaking time differed, and hence, grain growth might further progress. The diameter of the grain in Annealing 3 was significantly increased compared with that in Annealing 2. Even though differences in heating effect between Annealing 2 and Annealing 3 were slight, the rate of increase in temperature during growth of recrystallized nuclei in Annealing 3 was different from that in Annealing 2. Accordingly, due to differences in recrystallized textures formed in different texture formation processes due to the difference mentioned above, subsequent grain growth behavior might be significantly changed. However, the fundamental mechanism is not clearly understood.

In addition, elements added to starting materials were examined. As a result, it was discovered that magnetic flux density of a finished steel sheet was improved by adding Ni. The reason the magnetic flux density was improved might relate to the fact that Ni is a ferromagnetic element. However, the reason is not clearly understood. In addition, it was discovered that iron loss tended to be improved by adding Sn, Cu, P, or Cr. Iron loss might be improved by an increase of an intrinsic electric resistance.

Furthermore, it was discovered that, when an areal ratio of crystal grains in which crystal plane orientations thereof are within about 15° from the <111> axis (hereinafter referred to as P{111}) was optimized, iron loss could be effectively improved. Hereinafter, a detailed description will be given.

Steel ingots containing various amounts of Al were formed in which 2.5 percent by weight of Si, and 0.12 percent by weight of Mn were contained, and C, S, N, O, and B were respectively reduced to be 20 ppm or less. These ingots were heated to 1,100° C. and were then hot-rolled so as to be 2.4 mm thick. The hot-rolled sheets were annealed at 1,175° C. for 2 minutes, were pickled, and were cold-rolled at 250° C. so as to have a final thickness of 0.35 mm. The cold-rolled sheets were annealed for recrystallization at 1,100° C. for 5 minutes, thereby obtaining finished steel sheets. By changing the Al content, finished sheets having different crystal orientations were obtained.

From the finished steel sheets, Epstein samples of 30 mm in width and 280 mm in length were cut in the rolled direction (L direction) and in the direction perpendicular thereto (C direction), and the average magnetic flux densities and iron losses in the L direction and the C direction of the samples were measured. In addition, crystal grain orientations of the finished steel sheet were measured by an EBSP. The measurement was performed for approximately 2,000 crystal grains in an area 10 mm by 10 mm on the surface of the steel sheet.

A minimum difference in angles between the each crystal plane orientation and the <111> axis was analyzed based on the measurement results thus obtained. As a result, it was discovered that the magnetic flux density and the areal ratio of the crystal grains in which the crystal plane orientations thereof were within 15° from the <111> axis (hereinafter referred to as P{111}) had a close relationship therebetween.

Figure 13:
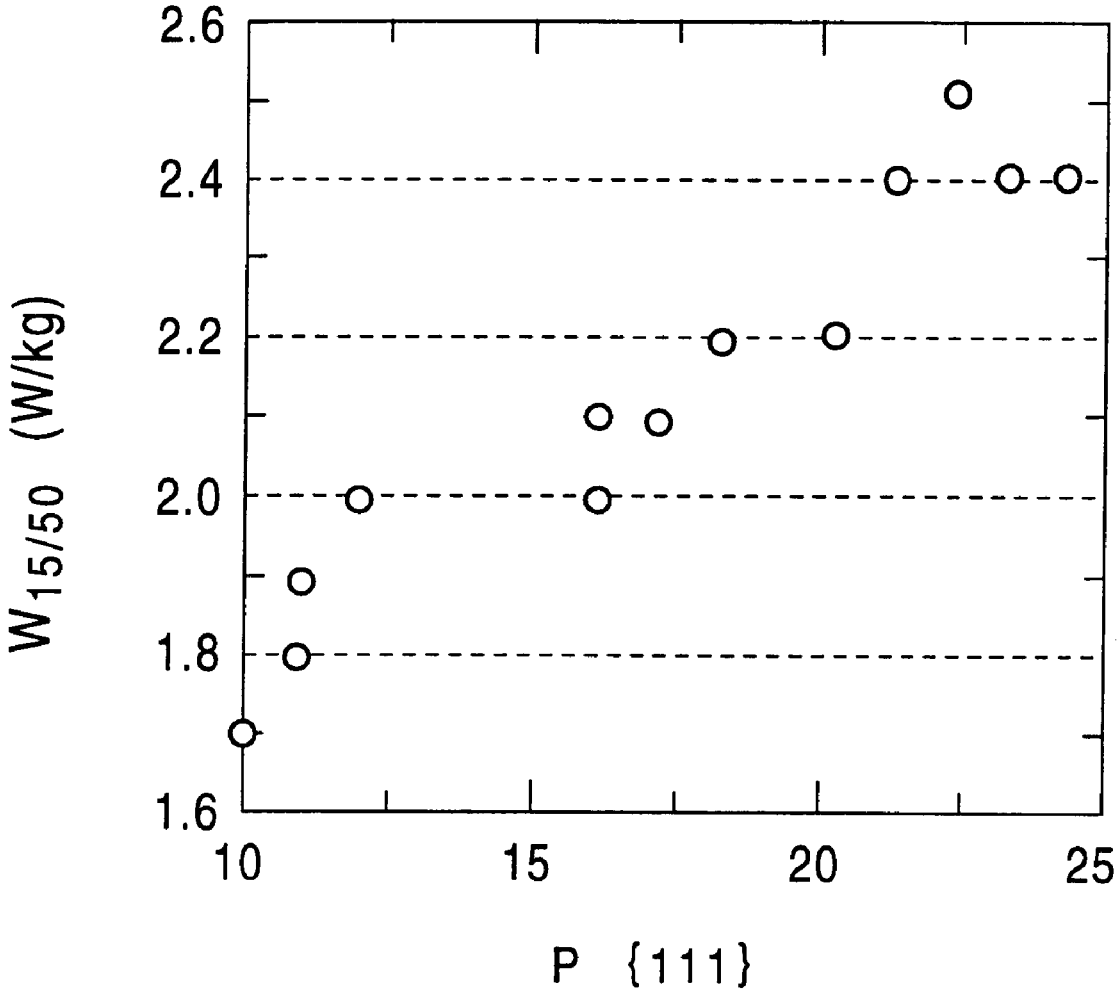
FIG. 13 is a graph showing the influence of P{111} on the iron loss of a finished steel sheet.

In FIG. 13, the relationship between the iron loss in the finished steel sheet and the P{111} is shown. As shown in FIG. 13, the iron loss in the finished steel sheet and the P{111} had a close relationship. In particular, it was discovered that, when the P{111} was 20% or less, a superior ion loss ($W_{15/50} \leqq 2.20$ W/kg) could be obtained. The reason for this is believed to be that, since the permissible range was relatively broader, such as 15° for P{111} calculation, the result was obtained by including contributions from the magnetic properties of other than {111}, such as {544}, {554}, {221}, and {332}.

In order to understand the influence of texture on magnetic properties, the following experiments were conducted.

A steel ingot was formed in which 2.6 percent by weight of Si, 0.13 percent by weight of Mn, and 0.009 percent by weight of Al were contained, and C, S, N, O, and B were respectively reduced to be 20 ppm or less. The ingot was heated to 1,050° C. and was hot-rolled so as to be 2.6 mm thick. The hot-rolled sheet was annealed at 1,150° C. for 3 minutes and was then pickled. Subsequently, the annealed sheet was cold-rolled at various temperatures between room temperature and 400° C. so as to have a final thickness of 0.35 mm. The cold-rolled sheet was annealed for recrystallization at 1,050° C. for 10 minutes, thereby obtaining a finished steel sheet.

From the finished steel sheet, Epstein samples of 30 mm in width and 280 mm in length were cut in the L direction and the C direction, and the average magnetic flux densities and iron losses in the L direction and the C direction for the-samples were measured.

Crystal grain orientations of the finished steel sheet were measured by an EBSP for approximately 2,000 crystal grains in an area 10 mm by 10 mm on the surface of the steel sheet, and P{111} was then obtained.

Figure 14A:
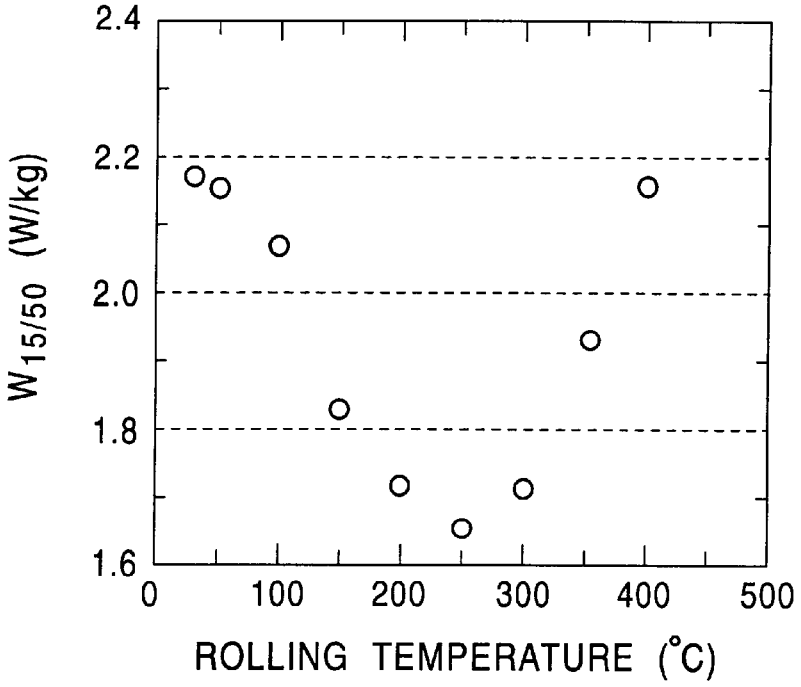
FIGS. 14A and 14B are graphs showing the influence of a temperature for cold rolling on an iron loss and P{111} of a finished steel sheet, respectively.
Figure 14B:
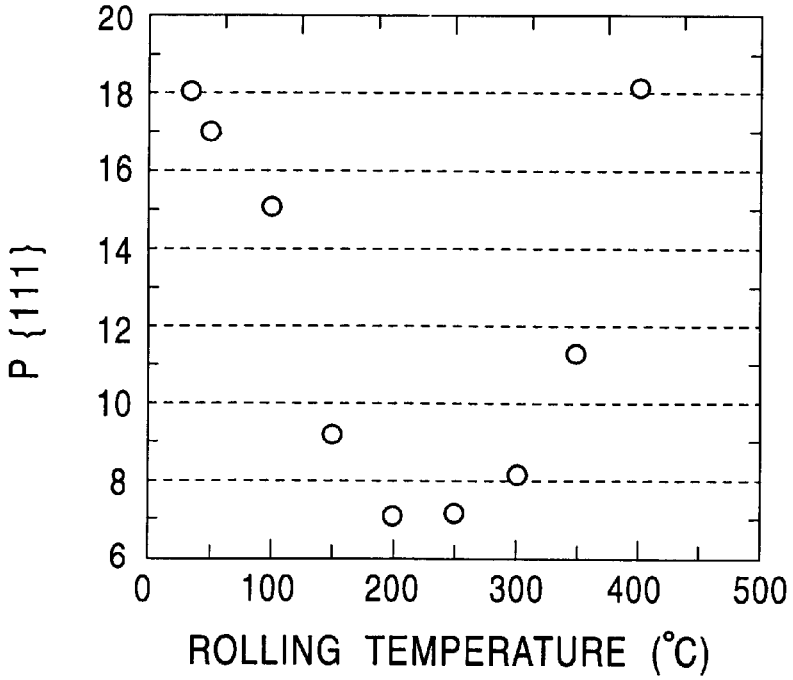

In FIGS. 14A and 14B, the relationship between the rolling temperature and the iron loss and the relationship between the rolling temperature and the P{111} are shown, respectively. As shown in FIGS. 14A and 14B, when the rolling temperature was controlled in the range from 150 to 350° C., the P{111} was smaller value, whereby a superior iron loss could be obtained.

Next, an experiment was performed by the same process described above using an ingot having the same composition described above except that annealing temperatures for hot-rolled sheets were variously changed.

Figure 15A:
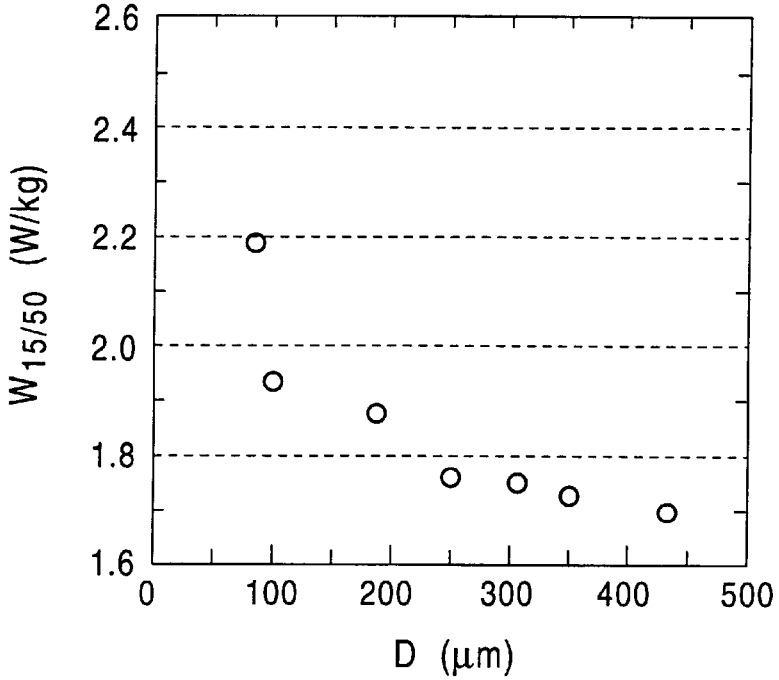
FIGS. 15A and 15B are graphs showing the influence of the average grain diameter after annealing for a hot-rolled steel sheet on an iron loss and P{111} of a finished steel sheet, respectively.
Figure 15B:
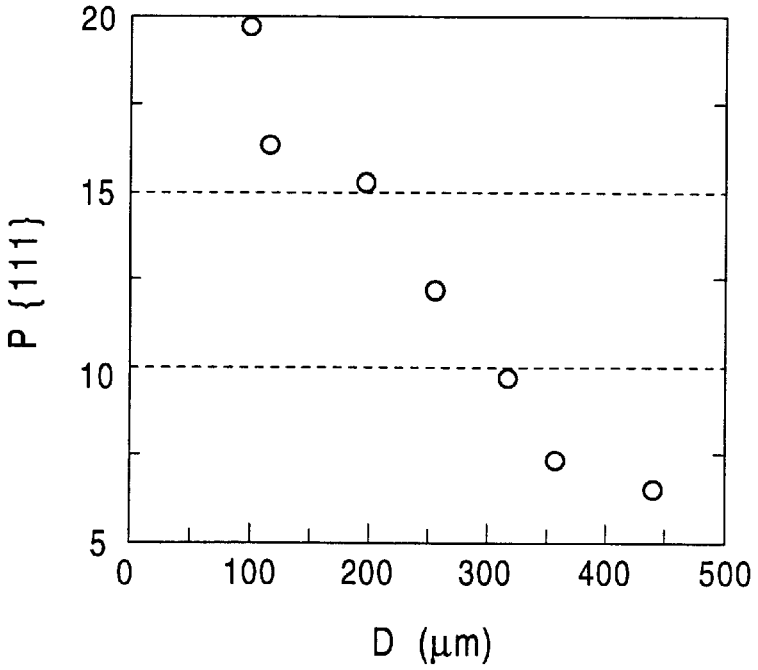

In FIGS. 15A and 15B, the relationship between the average grain diameter after annealing for a hot-rolled sheet and the iron loss, and the relationship between the average grain diameter after annealing for a hot-rolled sheet and the P{111} are shown,.respectively. As shown in FIGS. 15A and 15B, when the average grain diameter after annealing for a hot-rolled sheet, i.e., the average grain diameter before final cold rolling, was set to be about 100 μm or more, the P{111} was significantly decreased, whereby the iron loss properties could be further improved.

Hereinafter, the reasons for the specifications of components of the present invention will be described.

As a component of the magnetic steel sheet of the present invention, Si must be contained so as to increase electric resistance and to decrease iron loss. In order to satisfy the requirements mentioned above, Si must be contained in an amount of at least about 1.5 weight %. On the other hand, when the Si content exceeds about 8.0 weight %, the magnetic flux density is decreased, and workability of the finished steel sheet in fabrication is significantly degraded. Accordingly, the content of Si is set to be from about 1.5 to about 8.0 weight %.

Mn is an essential component to improve hot-workability. The effect thereof is slight when the content of Mn is less than about 0.005 weight %. On the other hand, when the content thereof exceeds about 2.50 weight %, the saturation flux density is decreased. Hence, the content of Mn is set to be from about 0.005 to about 2.50 weight %.

In order to obtain a desired crystal orientation according to the present invention, small amounts of components in the steel sheet must be reduced. That is, in the entire steel sheet excluding a coating on the surface thereof, the contents of C, S, N, O, and B must be respectively reduced to be about 50 ppm or less, and preferably, to be about 20 ppm or less. When the content thereof is more than that, the <Γ> in the crystal orientation of the finished steel sheet is increased, and hence, the iron loss is increased.

Next, control of crystal orientation must be performed. That is, in order to obtain superior magnetic properties,<Γ>, the average of Γ(J) in the rolled plane defined by the equation (1) must be about 0.200 or less. The reason for this is the same as previously described.

In addition, the average diameter of crystal grains in the finished steel sheet is preferably set to be from about 50 to about 500 μm. When the average diameter of crystal grains is less than about 50 μm, the hysteresis loss is increased. Accordingly, even if the present invention is applied thereto, an increase of iron loss cannot be avoided. In addition, since hardness is increased, workability is also degraded. On the other hand, when the average diameter exceeds about 500 μm, eddy-current loss is significantly increased. As a result, an increase in iron loss cannot be avoided even if the present invention is applied thereto.

In order to obtain a superior iron loss, it is preferable that P{111} be set to be about 20% or less. When the P{111} exceeds about 20%, the magnetic flux density of the finished steel sheet is significantly decreased and the iron loss thereof is also significantly increased.

In this connection, in order to maintain superior punching-out properties, it is preferable that the Vickers hardness be about 240 or less. As a method to obtain the hardness mentioned above, various methods may be considered; however, it is advantageous to primarily control the content of Si, Al, Mn, or the like.

Next, a manufacturing method for the magnetic steel sheet of the present invention will be described in detail.

As components of an ingot, the content of Si is set to be from about 1.5 to about 8.0 weight %, and the content of Mn is set to be from about 0.005 to about 2.50 weight %. The reason for this is the same as previously described.

The individual maximum contents of C, S, N, O, and B must be set to be about 50 ppm, and preferably, set to be about 20 ppm. Concerning C, the content thereof must be about 50 ppm or less at least prior to annealing for recrystallization. In order to accomplish that mentioned above, the content may be set to be about 50 ppm or less in a composition of a molten steel; alternatively, even if the content exceeds 50 ppm in the composition thereof, the content thereof may be reduced to be 50 ppm or less by a decarburization treatment in a subsequent step. When the individual contents of the impurities exceed about 50 ppm, the <Γ> after annealing for recrystallization is increased, and hence, the magnetic properties are degraded. The reason for this is believed to be that selective grain boundary migration is inhibited.

Control of Al content is the most effective technique to obtain a non-oriented magnetic steel sheet having the <Γ> of about 0.200 or less according to the present invention. In particular, in order to obtain a superior finished steel sheet composed of a texture having <Γ> of about 0.195 or less, the Al content is preferably set to be from about 0.0010 to about 0.10 weight %. When the Al content exceeds about 0.10 weight %, the texture varies, the <Γ> of the finished steel sheet is increased, and hence, the iron loss is increased, and the magnetic flux density is decreased. On the other hand, when the Al content is less than about 0.0010 weight %, silicon nitride is precipitated, and deformation behavior during rolling is influenced. Consequently, the texture varies, and hence, the <Γ> is increased to some extent, whereby the effect of a decrease in <Γ> by reduction of impurities, C, S, N, O, and B was lessened. Accordingly, when the Al content is set to be about 0.0010 weight % or more, it is advantageous to improve iron loss and magnetic flux density.

In addition to the method for controlling components, in order to obtain a superior texture having <Γ> of about 0.195 or less, it is advantageous to control conditions for annealing for a hot-rolled sheet. The conditions mentioned above are that annealing is performed in the temperature range from about 800 to about 1,200° C., and subsequently, cooling from about 800 to about 400° C. is performed at a rate of from about 5 to about 80° C./second.

When an annealing temperature for a hot-rolled sheet is less than about 800° C., recrystallization of the hot-rolled sheet insufficiently occurs, and the magnetic properties are also insufficiently improved. On the other hand, when an annealing temperature for a hot-rolled sheet is more than about 1,200° C., the diameters of crystal grains of the hot-rolled sheet are significantly increased, and cracks therein occur during cold rolling. Accordingly, an annealing temperature for a hot-rolled sheet is preferably set to be from about 800 to about 1,200° C. Concerning a cooling rate, it is preferably controlled as previously described.

Furthermore, by optionally adding Sb, the behavior of recrystallized nuclei growth can be changed. Consequently, <Γ> of the finished steel sheet can be reduced, and hence, superior magnetic properties can be obtained. When the content of Sb is less than about 0.01 weight %, improvement in texture cannot be observed. On the other hand, when the content of Sb is more than about 0.50 weight %, the steel sheet tends to be brittle, and hence, cold rolling is difficult to perform. Accordingly, the content of Sb is preferably set to be from about 0.01 to about 0.50 weight %.

In annealing for recrystallization, when a rate of increase in temperature in the range of from about 700° C. and above is set to be slow, such as about 100° C./hour or less, and when the temperature is increased to a maximum temperature between from about 750 to about 1,200° C., it is advantageous to facilitate grain growth and to improve magnetic properties. When a rate of increase in temperature in the range of from about 700° C. and above is more than about 100° C./hour, the effect of improving texture is decreased. Accordingly, the rate of increase in temperature is preferably set to be from about 100° C./hour or less. The minimum rate of increase in temperature is not specifically limited: however, when it is less than about 1° C./hour, annealing time is considerably increased, and hence, it is not advantageous from an economic point of view. When the maximum temperature in annealing for recrystallization is less than about 750° C., magnetic properties are degraded due to insufficient grain growth. On the other hand, when the maximum temperature is more than about 1,200° C., iron loss is increased due to progress in oxidation at a surface. Accordingly, the maximum temperature in annealing for recrystallization is preferably set to be from about 750 to about 1,200° C. The soaking time is not specified. However, in order to obtain a superior iron loss, a longer soaking, which is allowed from an economic point of view, is effective to facilitate grain growth.

Furthermore, in order to improve magnetic properties by significantly facilitating grain growth, it is effective that, during a first half of annealing for recrystallization, the temperature is rapidly increased at about 2° C./second or more from about 500 to about 700° C., and recrystallization is completed at about 700° C. or above, and in a second half of annealing for recrystallization, after the temperature is decreased to about 700° C. or less, it is again slowly increased at about 100° C./hour or less in the range of from about 700° C. and above to about 750 to about 1,200° C.

When the temperature is increased from about 500 to about 700° C. at less than about 2° C./second in the first half of annealing, an effect of facilitating recrystallization in the second half of annealing is decreased. Accordingly, a temperature is preferably increased from about 500 to about 700° C. at about 2° C./second or more in the first half of annealing for recrystallization. Similarly to the above, when the maximum temperature in the first half of annealing is less than about 750° C. or more than about 1,200° C., an effect of facilitating recrystallization in the second half of annealing is decreased. Accordingly, the maximum temperature is preferably from about 750 to about 1,200° C. in the first half of annealing for recrystallization. When a temperature is increased at more than about 100° C./hour in the second half of annealing, an effect of improving texture is decreased. Hence, a rate of increase in temperature is preferably set to be about 100° C./hour or less in the second half of annealing for recrystallization. When the maximum temperature in the second half of annealing is less than about 750° C., grain growth is insufficient, and when it is more than about 1,200° C., oxidation at surfaces occurs, whereby, in both cases, magnetic properties are degraded. Accordingly, the maximum temperature is preferably from about 750 to about 1,200° C. in the second half of annealing for recrystallization. The soaking time in the second half of annealing is not specified. However, in order to obtain a superior iron loss, a longer soaking, which is allowed from an economic point of view, is effective to facilitate grain growth.

Since an increase in temperature by 500° C. has no significant effect on recrystallizing behavior, it is not specifically limited. Cooling conditions are not specifically limited from the point of view of magnetic properties. However, from an economic point of view, the cooling rate is advantageously set to be from about 60° C./minute to about 10° C./hour.

In order to improve magnetic flux density, Ni may be added. When the content of Ni is less than about 0.01 weight %, improvement in magnetic flux density is not significant. On the other hand, when it is more than about 1.50 weight %, progress in texture is insufficient, and hence, magnetic properties are degraded. Accordingly, the content of Ni is preferably set to be from about 0.01 to about 1.50 weight %.

Similarly to the above, in order to improve iron loss, it is preferable that from about 0.01 to about 1.50 weight % Sn, from about 0.01 to about 1.50 weight % Cu, from about 0.005 to about 0.50 weight % P, and from about 0.01 to about 1.50 weight % Cr be added. When the contents thereof are less than the ranges mentioned above, an effect of improving iron loss is not observed, and when the contents are more than those, saturation flux density is decreased.

In addition, an ingot having the composition according to the present invention may be formed into slabs by common casting or by continuous casting or may be formed into thin steel sheets having a thickness of about 100 mm or less by direct casting. The slab is heated by a common method and is then hot-rolled. In this connection, the slab may be hot-rolled immediately after casting. In the case of the thin steel sheet, it may be hot-rolled, or may be transferred to the following step by omitting hot rolling. After hot-rolling, annealing for a hot-rolled sheet is performed, and cold rolling is performed at least one time with, if necessary, interim annealing between steps of cold rolling. Subsequently, annealing for recrystallization is performed, and when necessary, coating for insulation is performed. In the last stage, in order to improve iron loss of a laminated steel sheet, an insulating coating is applied to the surface of the steel sheet. Coating material may be a multilayer film composed of at least two films or may be mixed with resins or the like.

In order to decrease P{111}, it is preferable that an average crystal grain diameter be set to be about 100 $\mu$m or more prior to final cold rolling, and that the rolling temperature in at least one pass during final cold rolling be from about 150 to about 350° C. As a method for making an average crystal grain diameter prior to cold rolling to be about 100 $\mu$m or more, a method may be mentioned in which annealing for a hot-rolled sheet or interim annealing is performed at a high temperature such as about 1,000° C. or more or a method in which cold rolling with the reduction of thickness of from about 3 to about 7% is performed prior to annealing for a hot-rolled sheet.

EXAMPLE 1

After steel slabs having compositions shown in Table 1 were formed by continuous casting, the slabs were heated to 1,250° C. for 50 minutes and were formed into steel sheets 2.3 mm thick by hot rolling. The hot-rolled steel sheets were annealed at 1,150° C. for 60 seconds and were then cooled from 800° C. to 400° C. at 15° C./second. The annealed steel sheets were cold rolled at 170° C., so that the steel sheets having a final thickness of 0.35 mm were formed. Subsequently, annealing for recrystallization was performed at 1,050° C. for 3 minutes in a hydrogen atmosphere, and a semi-organic coating solution was coated and was then baked at 300° C., thereby yielding finished steel sheets.

From the finished steel sheets thus obtained, ring samples of 150 mm in outer diameter and 100 mm in inner diameter were cut, and the magnetic properties thereof were measured. Orientations of crystal grains in an area 10 mm by 10 mm on the surface of each finished steel sheet were measured by an EBSP, and the <Γ> was then calculated. The results are also shown in Table 1. It was understood that the finished steel sheet according to the present invention had superior magnetic properties.

TABLE 1

| | Component in ingot (weight %) | | | | | | | | | | Iron loss $W_{15/50}$ | Magnetic flux density $B_{50}$ | |
|---|---|---|---|---|---|---|---|---|---|---|---|---|---|
| No. | C | Si | Mn | Al | Sb | S | O | N | B | <Γ> | (w/kg) | (T) | Remarks |
| A1 | 23 | 3.43 | 0.12 | 0.005 | 0.04 | 17 | 11 | 23 | 3 | 0.178 | 1.85 | 1.727 | Example |
| A2 | 33 | 3.33 | 0.33 | 0.011 | 0.03 | 13 | 13 | 21 | 5 | 0.170 | 1.83 | 1.733 | Example |
| A3 | 31 | 3.54 | 0.25 | 0.019 | 0.08 | 10 | 10 | 9 | 12 | 0.169 | 1.90 | 1.720 | Example |
| A4 | 35 | 2.90 | 0.05 | 0.043 | 0.12 | 11 | 10 | 13 | 4 | 0.171 | 1.93 | 1.734 | Example |
| A5 | 31 | 3.53 | 0.12 | 0.085 | 0.09 | 17 | 11 | 23 | 5 | 0.175 | 1.85 | 1.707 | Example |
| A6 | 35 | 3.55 | 0.17 | 0.0008 | 0.02 | 12 | 9 | 22 | 2 | 0.193 | 2.03 | 1.670 | Example |
| A7 | 25 | 3.50 | 0.30 | 0.12 | 0.06 | 10 | 14 | 15 | 3 | 0.195 | 2.02 | 1.665 | Example |
| A8 | 22 | 3.10 | 0.25 | 0.38 | tr | 19 | 11 | 19 | 5 | 0.199 | 2.22 | 1.660 | Example |
| A9 | 33 | 3.50 | 0.13 | 0.006 | 0.05 | 65 | 14 | 20 | 3 | 0.213 | 2.50 | 1.630 | Comparative example |
| A10 | 41 | 3.44 | 0.34 | 0.005 | 0.04 | 23 | 75 | 20 | 5 | 0.222 | 3.13 | 1.622 | Comparative example |
| A11 | 35 | 3.35 | 0.03 | 0.004 | 0.03 | 11 | 9 | 70 | 4 | 0.211 | 2.44 | 1.641 | Comparative example |
| A12 | 23 | 3.80 | 0.25 | 0.015 | 0.02 | 15 | 11 | 18 | 51 | 0.220 | 2.52 | 1.610 | Comparative example |

Note: Concentration for C, S, O, N, and B is ppm

EXAMPLE 2

A slab was formed by continuous casting, which was composed 38 ppm C, 3.24 weight % Si, 0.15 weight % Mn, 0.013 weight % Al, 0.02 weight % Sb, 11 ppm S, 7 ppm O, 9 ppm N, 2 ppm B, and substantial iron as the balance. The slab was heated to 1,150° C. for 30 minutes and was formed into a steel sheet 2.9 mm thick by hot rolling. The hot-rolled sheet was annealed at 1,050° C. for 60 seconds and was then cooled from 800° C. to 400° C. at 8° C./second. The annealed sheet was cold-rolled, so that a steel sheet having a final thickness of 0.35 mm was formed. Subsequently, annealing for recrystallization was performed in hydrogen atmosphere in which a temperature was increased at a predetermined rate to a predetermined maximum temperature, both of which are respectively shown in Table 2, and the temperature was then decreased. The annealed steel sheet was coated with an inorganic coating solution and was then baked at 300° C., thereby yielding a finished steel sheet.

From the finished steel sheet thus obtained, ring samples of 150 mm in outer diameter and 100 mm in inner diameter were cut, and the magnetic properties thereof were measured. Orientations of the crystal grains in an area 10 mm by 10 mm on the surface of the finished steel sheet were measured by an EBSP, and the <Γ> was then calculated. The results are also shown in Table 2. It was understood that the finished steel sheet had superior magnetic properties, particularly, when annealing for recrystallization was performed in which a temperature was increased at 200° C./hour from room temperature to 700° C. and was increased at an average rate of 1 to 100° C./hour above 700° C. so as to reach a maximum temperature from 750 to 1,200° C.

TABLE 2

| No. | Rate of increase in temperature (more than 700° C.) (° C./h) | Maximum temperature (° C.) | <Γ> | Iron loss $W_{15/50}$ (w/kg) | Magnetic flux density $B_{50}$ (T) |
|---|---|---|---|---|---|
| B1 | 20 | 900 | 0.160 | 1.75 | 1.740 |
| B2 | 70 | 900 | 0.164 | 1.76 | 1.732 |
| B3 | 10 | 850 | 0.161 | 1.79 | 1.740 |
| B4 | 20 | 1100 | 0.160 | 1.70 | 1.738 |

TABLE 2-continued

| No. | Rate of increase in temperature (more than 700° C.) (° C./h) | Maximum temperature (° C.) | <Γ> | Iron loss $W_{15/50}$ (w/kg) | Magnetic flux density $B_{50}$ (T) |
|---|---|---|---|---|---|
| B5 | 15 | 780 | 0.162 | 1.81 | 1.729 |
| B6 | 120 | 900 | 0.175 | 1.89 | 1.726 |
| B7 | 20 | 725 | 0.185 | 2.34 | 1.708 |
| B8 | 50 | 1225 | 0.166 | 2.45 | 1.726 |

EXAMPLE 3

A thin cast steel sheet 4.5 mm thick having same compositions of Example 2 was formed by direct casting. The thin cast steel sheet was annealed at 1,150° C. for 30 seconds and was then cooled from 800° C. to 400° C. at 50° C./second. The annealed sheet was cold-rolled at room temperature, so that a cold-rolled steel sheet 1.6 mm thick was formed. Subsequently, the cold-rolled steel sheet was processed by interim annealing at 1,000° C. for 60 seconds and was then cold-rolled at room temperature, so that a cold-rolled steel sheet 0.20 mm thick was formed. The cold-rolled sheet thus formed was processed in an argon atmosphere by a first and a second annealing for recrystallization under the conditions shown in Table 3, thereby yielding finished steel sheets.

From the finished sheets thus obtained, ring samples of 150 mm in outer diameter and 100 mm in inner diameter were cut, and the magnetic properties thereof were measured. Orientations of the crystal grains in an area 10 mm by 10 mm on the surface of each finished steel sheet were measured by an EBSP, and the <Γ> was then calculated. The results are also shown in Table 3. It was understood that the finished steel sheet had superior magnetic properties, particularly, when annealing for recrystallization was performed in which a temperature was increased at 1° C. to 100° C./hour in a range of 700° C. and above so as to reach a maximum temperature of 750 to 1,200° C.

TABLE 3

| | Annealing hot-rolled sheet | | Annealing cold-rolled sheet | | | | |
|---|---|---|---|---|---|---|---|
| No. | Rate of increase in temperature (500° C.–700° C.) (° C./S) | Maximum temperature (° C.) | Rate of increase in temperature (more than 700° C.) (° C./h) | Maximum temperature (° C.) | <Γ> | Iron loss $W_{15/50}$ (w/kg) | Magnetic flux density $B_{50}$ (T) |
| C1 | 20 | 900 | 20 | 900 | 0.150 | 1.55 | 1.760 |
| C2 | 40 | 900 | 25 | 950 | 0.154 | 1.56 | 1.752 |
| C3 | 10 | 800 | 25 | 1000 | 0.161 | 1.59 | 1.740 |
| C4 | 20 | 1000 | 11 | 880 | 0.150 | 1.50 | 1.758 |
| C5 | 5 | 780 | 30 | 1050 | 0.152 | 1.61 | 1.749 |
| C6 | 1 | 800 | 25 | 900 | 0.170 | 1.80 | 1.731 |
| C7 | 20 | 650 | 25 | 900 | 0.171 | 1.82 | 1.728 |
| C8 | 20 | 900 | 200 | 900 | 0.170 | 1.85 | 1.726 |
| C9 | 20 | 900 | 15 | 700 | 0.173 | 1.91 | 1.720 |
| C10 | 20 | 900 | 40 | 1250 | 0.164 | 2.25 | 1.735 |

EXAMPLE 4

After steel slabs having compositions shown in Table 4 were formed by continuous casting, the slabs were heated to 1,200° C. for 50 minutes and were formed into steel sheets 2.6 mm thick by hot rolling. The hot-rolled sheets were annealed at 1,180° C. for 120 seconds and were then cooled from 800° C. to 400° C. at 30° C./second. The annealed sheets were cold-rolled at 150° C., so that steel sheets having a final thickness of 0.35 mm were formed. Subsequently, annealing for recrystallization was performed at 1,150° C. for 1 minute in an argon atmosphere, and a semi-organic coating solution was coated thereon and was then baked at 300° C., thereby yielding finished steel sheets.

From the finished steel sheets thus obtained, ring samples 150 mm in outer diameter and 100 mm in inner diameter were cut, and the magnetic properties thereof were measured. Orientations of the crystal grains in an area 10 mm by 10 mm on the surface of each finished steel sheet were measured by an EBSP, and the <Γ> was then calculated. The results are also shown in Table 4. It was understood that the finished steel sheets according to the present invention had superior magnetic properties.

TABLE 4

| | Component in ingot (weight %) | | | | | | | | | | | | | | | | |
|---|---|---|---|---|---|---|---|---|---|---|---|---|---|---|---|---|---|
| No. | C | Si | Mn | Al | Sb | Ni | Sn | Cu | P | Cr | O | N | S | B | <Γ> | Iron loss $W_{15/50}$ (w/kg) | Magnetic flux density $B_{50}$ (T) |
| D1 | 23 | 2.31 | 0.12 | 0.007 | 0.04 | tr | tr | tr | 20 | tr | 11 | 9 | 11 | 3 | 0.179 | 1.93 | 1.727 |
| D2 | 33 | 2.52 | 0.15 | 0.009 | 0.03 | 0.23 | tr | tr | 22 | tr | 13 | 11 | 23 | 4 | 0.180 | 1.90 | 1.727 |
| D3 | 24 | 2.27 | 0.25 | 0.018 | 0.05 | tr | 0.15 | tr | 15 | tr | 8 | 13 | 21 | 3 | 0.180 | 1.88 | 1.720 |
| D4 | 30 | 2.42 | 0.15 | 0.003 | 0.04 | tr | tr | 0.09 | 12 | tr | 10 | 12 | 16 | 1 | 0.178 | 1.86 | 1.745 |
| D5 | 35 | 2.62 | 0.03 | 0.005 | 0.08 | tr | tr | tr | 200 | tr | 18 | 6 | 8 | 3 | 0.180 | 1.87 | 1.742 |
| D6 | 30 | 2.55 | 0.10 | 0.022 | 0.05 | tr | tr | tr | 32 | 0.6 | 13 | 10 | 15 | 3 | 0.180 | 1.75 | 1.705 |

Note: Concentration for C, S, O, N, P and B is ppm

EXAMPLE 5

Steel slabs having compositions shown in Table 5 were formed by continuous casting. The slabs were heated to 1,150° C. for 20 minutes and were formed into steel sheets 2.8 mm thick by hot rolling. The hot-rolled sheets were annealed at 1,150° C. for 60 seconds. The annealed sheets were cold-rolled at 270° C., so that steel sheets having a final thickness of 0.35 mm were formed. Subsequently, annealing for recrystallization was performed at 1,050° C. for 2 minutes in a hydrogen atmosphere, and a semi-organic coating solution was coated thereon and was then baked at 300° C., thereby yielding finished steel sheets.

The magnetic properties (average in the L direction and the C direction) of the finished steel sheets were measured. Orientations of the crystal grains in an area 10 mm by 10 mm on the surface of each finished steel sheet were measured by an EBSP, and the <Γ> and P{111}, the areal ratio of crystal grains on the surface of the steel sheet were then calculated, in which the crystal plane orientations of the crystal grains were within 15° from the <111> axis.

In addition, hardness and workability of each finished steel sheet were also evaluated. Concerning workability, the finished sheets were laminated so as to be approximately 10 mm thick, and 100 holes 30 mm in diameter were formed in the laminate by using a plunger-type punching apparatus, so that workability was determined by the rate of crack occurrence.

In addition, the average grain diameters of the hot-rolled steel sheets after annealing for a hot-rolled sheet and of the finished steel sheets were also measured. The results are also shown in Table 5.

TABLE 5

| | Component in ingot (wt % or ppm) | | | | | | | | Average grain diameter before cold rolling | Iron loss $W_{15/50}$ | Magnetic flux density $B_{50}$ | Grain diameter of finished steel sheet | Hardness | | P {111} | Rate of crack occurrence in fabrication | |
|---|---|---|---|---|---|---|---|---|---|---|---|---|---|---|---|---|---|
| No. | C | Si | Mn | Al | S | O | N | B | (μm) | (W/kg) | (T) | (μm) | Hv | <Γ> | (%) | (%) | Remarks |
| E1 | 41 | 3.03 | 0.12 | 0.005 | 17 | 11 | 23 | 3 | 280 | 1.85 | 1.757 | 210 | 185 | 0.166 | 10 | 0 | Example |
| E2 | 36 | 3.03 | 0.33 | 0.011 | 13 | 13 | 21 | 5 | 270 | 1.83 | 1.763 | 220 | 189 | 0.153 | 12 | 0 | Example |
| E3 | 21 | 2.84 | 0.25 | 0.019 | 10 | 10 | 9 | 12 | 250 | 1.90 | 1.750 | 190 | 191 | 0.160 | 13 | 0 | Example |
| E4 | 45 | 2.90 | 0.05 | 0.043 | 11 | 10 | 13 | 4 | 230 | 1.93 | 1.744 | 180 | 196 | 0.151 | 15 | 0 | Example |
| E5 | 41 | 2.53 | 0.12 | 0.085 | 17 | 11 | 23 | 5 | 230 | 1.93 | 1.737 | 170 | 185 | 0.183 | 10 | 0 | Example |
| E6 | 35 | 2.55 | 0.17 | 0.0008 | 12 | 9 | 22 | 2 | 280 | 2.20 | 1.700 | 220 | 183 | 0.185 | 20 | 0 | Example |
| E7 | 45 | 2.50 | 0.30 | 0.120 | 10 | 14 | 15 | 3 | 210 | 2.20 | 1.705 | 170 | 215 | 0.189 | 19 | 0 | Example |
| E8 | 12 | 2.80 | 0.75 | 0.010 | 19 | 11 | 19 | 25 | 160 | 2.22 | 1.700 | 140 | 210 | 0.191 | 19 | 0 | Example |
| E9 | 15 | 4.30 | 0.13 | 0.007 | 13 | 14 | 20 | 5 | 230 | 2.03 | 1.685 | 200 | 250 | 0.201 | 19 | 12 | Comparative example |
| E10 | 30 | 1.73 | 0.15 | 0.006 | 11 | 10 | 11 | 4 | 20 | 2.98 | 1.660 | 30 | 151 | 0.215 | 33 | 0 | Comparative example |
| E11 | 41 | 3.50 | 0.13 | 0.50 | 9 | 8 | 13 | 4 | 240 | 1.90 | 1.678 | 210 | 245 | 0.208 | 21 | 3 | Comparative example |
| E12 | 33 | 2.50 | 0.13 | 0.006 | 63 | 14 | 20 | 3 | 190 | 2.50 | 1.700 | 150 | 201 | 0.205 | 22 | 2 | Comparative example |
| E13 | 41 | 2.44 | 0.34 | 0.005 | 23 | 55 | 20 | 5 | 150 | 3.13 | 1.655 | 93 | 210 | 0.216 | 22 | 4 | Comparative example |
| E14 | 35 | 2.35 | 0.03 | 0.004 | 11 | 9 | 70 | 4 | 160 | 2.44 | 1.701 | 160 | 202 | 0.213 | 24 | 2 | Comparative example |
| E15 | 23 | 2.80 | 0.25 | 0.015 | 15 | 11 | 18 | 51 | 130 | 2.62 | 1.690 | 130 | 215 | 0.209 | 29 | 0 | Comparative example |

As shown in the table 5, when steel sheets had compositions in the range of the present invention, finished steel sheets having superior workability were obtained in addition to having superior magnetic properties.

EXAMPLE 6

A slab was formed by continuous casting, which was composed of 38 ppm C, 3.74 wt % Si, 0.35 wt % Mn, 0.013 wt % Al, 11 ppm S, 7 ppm O, 9 ppm N, and substantial iron as the balance. The slab was heated to 1,100° C. for 20 minutes and was formed into steel sheet 3.2 mm thick by hot rolling. The hot-rolled steel sheet was annealed at a temperature shown in Table 6 for 60 seconds. The annealed steel sheet was cold-rolled at a temperature shown in Table 6, so that a steel sheet having a final thickness of 0.50 mm was formed. Subsequently, annealing for recrystallization was performed at a temperature shown in Table 6 for 120 seconds, and the annealed sheet was coated with an inorganic coating solution and was then baked at 300° C., thereby yielding a finished steel sheet.

The magnetic properties, <Γ>, P{111}, hardness, and workability for the finished steel sheet, and average grain diameters of the finished steel sheet and the hot-rolled sheet after annealing for a hot-rolled sheet were measured. The results are also shown in Table 6.

TABLE 6

| No. | Annealing temperature for hot-rolled sheet (° C.) | Average grain diameter before cold rolling (μm) | Annealing temperature (° C.) | Annealing temperature for recrystal-lization (° C.) | Iron loss $W_{15/50}$ (W/kg) | Magnetic flux density $B_{50}$ (T) | Grain diameter of finished steel sheet (μm) | Hardness Hv | <Γ> | P {111} (%) | Rate of crack occurrence in fabrication (%) | Remarks |
|---|---|---|---|---|---|---|---|---|---|---|---|---|
| F1 | 900 | 60 | 250 | 1050 | 2.15 | 1.700 | 220 | 210 | 0.182 | 11 | 0 | Example |
| F2 | 1120 | 250 | 250 | 1050 | 1.95 | 1.746 | 250 | 208 | 0.165 | 9 | 0 | Example |
| F3 | 1120 | 250 | 50 | 1050 | 2.13 | 1.717 | 240 | 213 | 0.158 | 16 | 0 | Example |
| F4 | 1120 | 260 | 250 | 975 | 2.17 | 1.702 | 130 | 220 | 0.173 | 18 | 0 | Example |
| F5 | 1120 | 250 | 200 | 1100 | 1.94 | 1.738 | 330 | 205 | 0.160 | 13 | 0 | Example |
| F6 | 1120 | 250 | 200 | 850 | 3.15 | 1.660 | 40 | 245 | 0.215 | 23 | 5 | Comparative example |
| F7 | 1120 | 250 | 200 | 1200 | 2.43 | 1.700 | 550 | 200 | 0.185 | 16 | 3 | Comparative example |

As shown in Table 6, it was understood that finished steel sheet had particularly superior magnetic properties and, superior workability when the grain diameter thereof before cold rolling was increased, and the temperature for cold rolling was increased.

EXAMPLE 7

Thin cast steel sheets 4.5 mm thick having compositions shown in Table 7 were formed by direct casting. The thin cast steel sheets were annealed at 1,150° C. for 60 seconds and were then cold-rolled at room temperature, so that cold-rolled steel sheets having an interim thickness of 1.2 mm were formed. Subsequently, the cold-rolled steel sheets were processed by interim annealing at 1,000° C. for 60 seconds and were then cold-rolled at room temperature, so that cold-rolled steel sheets having a final thickness of 0.35 mm were formed. The cold-rolled sheets thus formed were processed in an argon atmosphere by annealing for recrystallization at 1,025° C. for 5 minutes, thereby yielding finished steel sheets.

The magnetic properties, <Γ>, P{111}, hardness, workability, and average grain diameters were measured for the finished steel sheets. The results are shown in Table 8.

TABLE 7

| Steel | Composition (wt % or ppm) | | | | | | | | | | | | | |
|---|---|---|---|---|---|---|---|---|---|---|---|---|---|---|
| No. | C | Si | Mn | Al | Ni | Sn | Sb | Cu | P | Cr | O | N | S | B |
| A | 23 | 3.31 | 0.12 | 0.007 | tr | tr | tr | tr | 20 | tr | 11 | 9 | 11 | 3 |
| B | 33 | 3.52 | 0.15 | 0.009 | 0.23 | tr | tr | tr | 22 | tr | 13 | 11 | 23 | 4 |
| C | 24 | 3.27 | 0.25 | 0.018 | tr | 0.15 | tr | tr | 15 | tr | 8 | 13 | 21 | 3 |
| D | 30 | 3.42 | 0.15 | 0.003 | tr | tr | 0.07 | tr | 12 | tr | 10 | 12 | 16 | 1 |
| E | 35 | 3.62 | 0.03 | 0.005 | tr | tr | tr | 0.20 | 8 | tr | 18 | 6 | 8 | 3 |
| F | 22 | 3.46 | 0.33 | 0.043 | tr | tr | tr | tr | 0.03 | tr | 10 | 12 | 12 | 2 |
| G | 39 | 3.42 | 0.15 | 0.003 | tr | tr | tr | tr | tr | tr | 10 | 12 | 16 | 1 |
| H | 30 | 3.55 | 0.10 | 0.022 | tr | tr | tr | tr | tr | 0.50 | 13 | 10 | 15 | 3 |

TABLE 8

| No. | Steel No. | Iron loss $W_{15/50}$ (W/kg) | Magnetic flux density $B_{50}$ (T) | Grain diameter of finished steel sheet (μm) | Hardness Hv | <Γ> | P {111} (%) | Rate of crack occurrence in fabrication (%) | Remarks |
|---|---|---|---|---|---|---|---|---|---|
| 1 | A | 1.93 | 1.747 | 230 | 190 | 0.145 | 5 | 0 | Example |
| 2 | B | 1.90 | 1.757 | 240 | 188 | 0.141 | 4 | 0 | Example |
| 3 | C | 1.88 | 1.740 | 200 | 195 | 0.149 | 4 | 0 | Example |
| 4 | D | 1.86 | 1.745 | 210 | 193 | 0.144 | 3 | 0 | Example |
| 5 | E | 1.87 | 1.742 | 220 | 205 | 0.145 | 3 | 0 | Example |
| 6 | F | 1.88 | 1.745 | 210 | 185 | 0.143 | 5 | 0 | Example |
| 7 | G | 1.86 | 1.745 | 210 | 193 | 0.144 | 3 | 0 | Example |
| 8 | H | 1.80 | 1.735 | 200 | 196 | 0.151 | 4 | 0 | Example |

As shown in Table 8, when the steel sheets having compositions in the range of the present invention were formed, the finished steel sheets had superior magnetic properties and superior workability.

According to the present invention, it is possible to provide a non-oriented magnetic steel sheet having an iron loss and magnetic properties, both of which are far superior to those obtained by conventional techniques.

While the present invention has been described above in connection with several preferred embodiments, it is to be expressly understood that those embodiments are solely for illustrating the invention, and are not to be construed in a limiting sense. After reading this disclosure, those skilled in this art will readily envision insubstantial modifications and substitutions of equivalent materials and techniques, and all such modifications and substitutions are considered to fall within the true scope of the appended claims.

What is claimed is:

1. A method for manufacturing a non-oriented magnetic steel sheet having a low iron loss and a high magnetic flux density, comprising the steps of:

preparing a molten steel containing from about 1.5 to about 8.0 weight % silicon, from about 0.005 to about 1.50 weight % manganese, and not more than about 50 ppm of each of sulfur, nitrogen, oxygen, and boron;

forming a slab from the molten steel;

hot rolling the slab;

annealing the hot-rolled steel sheet;

cold rolling, comprising cold rolling the annealed steel sheet once or cold rolling the annealed steel sheet at least twice with an interim annealing step therebetween, so as to achieve a final thickness; and annealing the cold-rolled steel sheet for recrystallization;

wherein the carbon content is controlled to be about 50 ppm or less during preparation of molten steel or prior to the step of annealing the cold-rolled sheet for recrystallization, and wherein the step of annealing the hot-rolled sheet is performed in a temperature range from about 800 to about 1,200° C. and a temperature is subsequently decreased from about 800 to about 400° C. at a rate of from about 5 to about 80° C./second.

2. The method according to claim 1, wherein, in the step of annealing the cold-rolled sheet for recrystallization, the rate of increase in temperature is set to be about 100° C./hour or less in a range of from about 700° C. and above so that the temperature reaches a range of from about 750 to about 1,200° C.

3. The method according to claim 1, wherein, in the step of annealing the cold-rolled sheet for recrystallization, the rate of increase in temperature is set to be about 2° C./second or more in a range from about 500 to about 700° C., the temperature is increased to about 700° C. or above so as to complete recrystallization of the steel sheet, the temperature is then decreased to a range of from about 700° C. or below and again increased, the rate of increase in temperature being set to be about 100° C./hour or less in the range of from about 700° C. and above so that the temperature reaches a range of from about 750 to about 1,200° C.

4. The method according to claim 1, wherein an average crystal grain diameter is set to be about 100 $\mu$m or more prior to final cold rolling, and the final cold rolling is performed at from about 150 to about 350° C. in at least one pass thereof.

5. The method according to claim 1, wherein the molten steel further comprises from about 0.0010 to about 0.10 weight % aluminum.

6. The method according to claim 1, wherein the molten steel further comprises from about 0.01 to 0.50 weight % antimony.

7. The method according to claim 1, wherein the molten steel further comprises at least one member selected from the group consisting of from about 0.01 to about 3.50 weight % nickel, from about 0.01 to about 1.50 weight % tin, from about 0.01 to about 1.50 weight % copper, from about 0.005 to about 0.50 weight % phosphorus, and from about 0.01 to about 1.50 weight % chromium.

* * * * *